US011268332B2

(12) United States Patent
Ziegler et al.

(10) Patent No.: US 11,268,332 B2
(45) Date of Patent: Mar. 8, 2022

(54) SELF-ALIGNING, MULTI-STAB CONNECTIONS FOR MANAGED PRESSURE DRILLING BETWEEN RIG AND RISER COMPONENTS

(71) Applicant: Weatherford Technology Holdings, LLC, Houston, TX (US)

(72) Inventors: Robert Ziegler, Houston, TX (US); Julmar Shaun S. Toralde, Houston, TX (US); Gordon Thomson, Humble, TX (US); Edvin Andersen, Kristiansand (NO); Øystein Christensen, Kristiansand (NO); Anthony James Reid, Waller, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/797,148

(22) Filed: Feb. 21, 2020

(65) Prior Publication Data

US 2020/0270955 A1 Aug. 27, 2020

Related U.S. Application Data

(60) Provisional application No. 62/808,640, filed on Feb. 21, 2019.

(51) Int. Cl.
*E21B 19/00* (2006.01)
*E21B 33/035* (2006.01)

(52) U.S. Cl.
CPC ..... *E21B 19/002* (2013.01); *E21B 33/0355* (2013.01)

(58) Field of Classification Search
CPC ..... E21B 19/002
See application file for complete search history.

(56) References Cited

U.S. PATENT DOCUMENTS 4,668,126 A 5/1987 Burton
6,938,695 B2 9/2005 Williams
(Continued)

FOREIGN PATENT DOCUMENTS

EP 2499327 A2 9/2012
WO 2014120130 A1 7/2014
WO 2019033126 A1 2/2019

OTHER PUBLICATIONS

Int'l Search Report received in copending PCT Application No. PCT/US2020/019160 dated May 7, 2020, 14 pages.
Offshore, Integrated MPD system aids in drilling operation offshore Brazil, obtained from www.offshore-mag.com/, dated Oct. 14, 2016, 10 pages.
AFGLOBAL, "MPD Active Pressure Management", copyright 2017, 10 pages.
(Continued)

*Primary Examiner* — Matthew R Buck
(74) *Attorney, Agent, or Firm* — Blank Rome LLP

(57) ABSTRACT

A riser extending from a floating rig includes one or more flow control devices having at least one flow connection and having at least one control connection. A riser manifold is disposed on the riser above the one or more flow control devices and has a first mechanical connector, a first flow coupling, and a first control coupling. A rig manifold can be manipulated by an arm to couple in an automated manner to the riser manifold when running the riser from the rig. The rig manifold has a second mechanical connector that mechanically connects to the first mechanical connector of the riser manifold. Additionally, the rig manifold has a second flow coupling mating with the first flow coupling of the riser manifold for conducting flow, and has a second control coupling mating with the first control coupling of the riser manifold for conducting control.

24 Claims, 12 Drawing Sheets

(56) References Cited

U.S. PATENT DOCUMENTS

| | | | | |
|---|---|---|---|---|
| 7,040,393 | B2 | 5/2006 | Adams et al. | |
| 7,658,228 | B2 | 2/2010 | Moksvold | |
| 8,267,179 | B2 | 9/2012 | Butcher et al. | |
| 8,875,793 | B2 | 11/2014 | Christensen et al. | |
| 9,458,689 | B2 | 10/2016 | Mancuso et al. | |
| 9,702,205 | B2 | 7/2017 | Jansen et al. | |
| 9,719,310 | B2 * | 8/2017 | MacGregor | E21B 17/01 |
| 9,759,018 | B2 * | 9/2017 | Stibich | E21B 19/004 |
| 10,273,766 | B1 * | 4/2019 | Batista | E21B 19/004 |
| 2008/0210471 | A1 | 9/2008 | Bailey et al. | |
| 2011/0056701 | A1 | 3/2011 | Jones et al. | |
| 2011/0101682 | A1 * | 5/2011 | Vatne | E21B 17/01 285/308 |
| 2011/0253445 | A1 | 10/2011 | Hannegan et al. | |
| 2011/0266003 | A1 | 11/2011 | Singh et al. | |
| 2012/0318517 | A1 * | 12/2012 | Christensen | E21B 19/004 166/345 |
| 2013/0014991 | A1 | 1/2013 | Leuchtenberg | |
| 2013/0168101 | A1 | 7/2013 | Bryson et al. | |
| 2013/0168578 | A1 | 7/2013 | Leuchtenberg et al. | |
| 2013/0233562 | A1 | 9/2013 | Leuchtenberg | |
| 2013/0240214 | A1 * | 9/2013 | Faye | E21B 19/002 166/345 |
| 2014/0048331 | A1 | 2/2014 | Boutalbi et al. | |
| 2014/0048731 | A1 | 2/2014 | Leuchtenberg et al. | |
| 2016/0076323 | A1 | 3/2016 | Fraczek et al. | |
| 2016/0230480 | A1 * | 8/2016 | Jansen | E21B 17/01 |

OTHER PUBLICATIONS

Offshore, "Asia/Pacific-spurs-demand-for-integrated deepwater MPD systems," obtained from www.offshore-mag.com, Mar. 11, 2015, 11 pages.

Mi Swaco, "Below Tension Ring Rotating Control Device—18 3/4-in submersible rotating control device", Brochure, copyright 2019, 2 pages.

FES International, "Hydraulic/Electric/Fibre Optic Stab Plates", undated, obtained from www.fesinternational.com on Jan. 20, 2019, 7 pages.

Future Production A/S, "Handsfree Gooseneck Handling System", Product & Operations Bulletin, Rev. Apr. 24, 2017, 3 pages.

Hess, "Deepwater MPD Jakarata Drilling Superintendents Meeting", Oct. 12, 2011, 16 pages.

Weatherford, "Seashield Rotating Control Devices Enabling closed-loop drilling in all marine environments using the industry's most reliable RCDs," copyright 2016, 16 pages.

Unitech, "MQC Terminator Charlie X-I Rov-Operated MQC/Stab Plate", undated, obtained from unitechsubsea.com on, Jan. 20, 2019, 2 pages.

Drilling Contractor, "RCD-for-dp-drillship-takes-mpd-deeper," obtained from www.drillingcontractor.org, dated Jul. 14, 2011, 4 pages.

Schlumberger, "First Deepwater MPD Integrated Solution Enables Drilling 5,302-ft Interval in One Run", Brochure, copyright 2018, 2 pages.

Subsea Connection Systems, "Stap Plates and Quick Couplings MCD Series Plates/DSL Series Couplings QCD-MCD/DSL", Apr. 2016, 4 pages.

* cited by examiner

SELF-ALIGNING, MULTI-STAB CONNECTIONS FOR MANAGED PRESSURE DRILLING BETWEEN RIG AND RISER COMPONENTS

CROSS-REFERENCE TO RELATED APPLICATIONS

This application claims the benefit of U.S. Appl. No. 62/808,640 filed 21 Feb. 2019, which is incorporated herein by reference in its entirety.

BACKGROUND OF THE DISCLOSURE

Drilling operations offshore use a riser that connects from a drilling vessel or rig to a BOP stack, which is mounted on a wellhead on the sea floor. To deploy the BOP stack and the riser to the wellhead, the BOP stack is skidded in at a sledge in a moonpool at a cellar deck under the rig floor. A section of riser is installed via a ball joint to the BOP stack. Kill and choke lines from the BOP stack are run past the ball joint and are coiled a few turns on the riser section to accommodate the torsional movements in the ball joint.

The BOP stack and riser section are then lowered from the rig floor, and the riser section is held in a spider. Thereafter, additional sections of riser are connected one to another as the riser and the BOP stack are lowered from the rig until the BOP stack reaches the depth of the wellhead. This process terminates by installing a slip joint on top of the last riser section. A typical slip joint has a lower outer barrel and an upper inner barrel, which can slide in the outer barrel. In this way, the sliding inner barrel hung from the vessel can follow the vertical movements of the vessel.

These deployment steps typically take place outside the template of the wellhead on the seafloor to prevent a catastrophe should the riser be lost and dropped. Once the riser is lowered to depth, the BOP stack and the riser are brought over the template, and the BOP stack is then lowered down to lock onto the wellhead at the seafloor.

During operations, the riser guides a drillstring from the rig floor to the BOP stack, through which the drillstring can pass to drill further downhole in a formation. During drilling, drilling fluid is pumped from a mud pump system at the rig, down through the drillstring and out through the drill bit. The drilling fluid washes the bit and the bottom of the hole clean of cuttings. The density and the viscous properties of the drilling fluid brings the cuttings back up through the borehole, through the BOP stack, and finally up through the riser to the rig.

Normally, kill and choke lines are run from the rig and along the riser to control operations. For example, the kill line can deliver heavy fluid used to "kill" the well, and the choke line can deliver flow from the BOP stack to an appropriate kill-choke manifold for well control. The drillstring can be cut by a shear ram in the BOP stack, or a choke ram can be closed around the drillstring in the BOP stack. In addition to the kill and choke lines, there may be conduit-lines for controlling hydraulic valves and connections in the BOP stack, and there may be "booster" lines for injecting fluid. The riser may also have flow control devices that are connected to lines on the rig.

Flow hoses and umbilicals from the rig must be connected to the riser lines so flow, hydraulics, and the like can be communicated to the flow control elements and the BOP stack. The flow hoses and umbilicals are connected while the riser is being run and the BOP stack is a few feet above the depth of the wellhead. Typically, the connection is done manually with assistance from operators who hang in ride belts. A considerable amount of rig time is needed for the operators to rig up the flow hoses and umbilicals while the riser is sitting in the spider. This typically requires a window of two or more days of suitable weather to avoid high loads on the riser should the weather turn bad.

The subject matter of the present disclosure is directed to overcoming, or at least reducing the effects of, one or more of the problems set forth above.

SUMMARY OF THE DISCLOSURE

According to the present disclosure, an apparatus is used for connecting rig lines of a managed pressure drilling (MPD) system on a floating rig to a riser. The rig lines include a rig flow line for conducting flow of the MPD system and include a rig control line for conducting control of the MPD system. The riser has an internal passage.

The apparatus comprises a riser manifold and a rig manifold. The riser manifold is disposed on the riser and comprises: a first mechanical connector disposed thereon, a first flow coupling for conducting the flow of the MPD system, and a first control coupling for conducting the control of the MPD system.

The rig manifold is configured to removably position adjacent the riser manifold. The rig manifold comprises: a second mechanical connector disposed thereon, a second flow coupling disposed in fluid communication with the rig flow line for conducting the flow of the MPD system, and a second control coupling disposed in control communication with the rig control line for conducting the control of the MPD system.

The first and second mechanical connectors are configured to mechanically connect together. The second flow coupling is configured to mate in a flow connection with the first flow coupling for conducting the flow of the MPD system. The second control coupling is configured to mate in a control connection with the first control coupling for conducting the control of the MPD system.

In general, the rig lines can include at least one additional rig flow line in communication with the MPD system. The riser manifold can comprise at least one additional first flow coupling for conducting the MPD flow of the MPD system, and the rig manifold can comprise at least one additional second flow coupling disposed in flow communication with the at least one additional rig flow line for conducting the MPD flow. The at least one additional second flow coupling can be configured to mate in at least one additional flow connection with the at least one additional first flow coupling for conducting the flow.

In general, the rig lines can include at least one additional rig control line in communication with the MPD system. The riser manifold can comprise at least one additional first control coupling for conducting the control of the MPD system, and the rig manifold can comprise at least one additional second control coupling disposed in control communication with the at least one additional rig control line for conducting the control. The at least one additional second control coupling can be configured to mate in at least one additional control connection with the at least one additional first flow coupling for conducting the control.

The first mechanical connector can comprise a pair of guide sleeves defined in a first face of the riser manifold. The second mechanical connector can comprise a pair of guide posts extending from a second face of the rig manifold. The guide posts can be configured to insert into the guide sleeves to mechanically connect the rig manifold to the riser manifold.

The first flow coupling can comprise a female receptacle defined in a first face of the riser manifold, and the second flow coupling can comprise a male nipple extending from a second face of the rig manifold. The male nipple can be configured to insert into the female receptacle to make the flow connection.

The first control coupling can comprise at least one of a female electrical coupling, a female hydraulic coupling, and a female fiber optic coupling, and the control coupling can comprise at least one of a male electrical coupling, a male hydraulic coupling, and a male fiber optic coupling. The male control coupling can be configured to insert into the female control coupling to make the control connection.

The apparatus can further comprise an arm extending from the floating rig for manipulating the rig manifold. The arm can be configured to: move the rig manifold relative to the riser manifold, mate the rig manifold to the riser manifold, and disconnect from the rig manifold. The arm can be further configured to: connect to the rig manifold mated with the riser manifold, and disconnect the rig manifold from the riser manifold.

The rig manifold can define a plurality of carry slots therein, and the arm can comprise a plurality of carry posts removably inserted in the slots of the rig manifold. The at least one second mechanical connector can comprise a rotatable lock, and the arm can comprise a rotatable key removably engaging the rotatable lock.

The apparatus can comprise first and second mating plates. The first mating plate can be disposed on a first face of the riser manifold and can have the first control coupling. The second mating plate can be disposed on a second face of the rig manifold and can have the second control coupling. At least one of the first and second mating plates can be adjustable relative to the respective first and second face.

For example, the second face can define a cavity therein, and the second mating plate can be disposed in the cavity and can be adjustable relative to the second face. The second mating plate can be adjustably longitudinally, laterally, or both relative to the second face.

In general, the first control coupling can be adjustable relative to a first face of the riser manifold; and/or the second control coupling can be adjustable relative to a second face of the rig manifold.

For the apparatus, the one flow connection for the first and second flow couplings can comprise at least one of: a first MPD connection to a buffer manifold of the MPD system, a second MPD connection to a choke manifold of the MPD system, a boost connection, a glycol injection connection, a hot connection, a spare connection, and a pumped riser connection.

The apparatus can further comprise a flow control device disposed on the riser and being configured to at least partially control communication of the internal passage of the riser. The flow control device can be disposed in at least one of: (i) flow communication with the second flow coupling and (ii) control communication with the second control coupling.

For example, the flow control device can comprise a valve disposed in the flow communication with the second flow coupling and disposed in the control communication with the second control coupling. The valve can be controllable to control flow between the second flow coupling and the internal passage of the riser.

In another example, the flow control device can comprise a seal configured to at least partially control flow in the internal passage of the riser. Further, the seal can comprise an actuator disposed in the control communication with the second control coupling.

The riser can have riser lines including a riser flow line for conducting the flow and including a riser control line for conducting the control. The first flow coupling for the apparatus can be disposed in flow communication with the flow control device via the riser flow line, and the first control coupling for the apparatus can be disposed in control communication with the flow control device via the riser control line.

In general, the flow control device can comprise a rotating control device, an annular isolation device, or a controllable flow spool valve.

According to the present disclosure, an apparatus is used for connecting rig lines of a managed pressure drilling (MPD) system on a rig to a riser. The rig lines including at least one MPD flow line and at least one MPD control line. The riser has an internal passage. The apparatus comprising: one or more managed pressure drilling (MPD) devices, a riser manifold, and a rig manifold.

The one or more managed pressure drilling (MPD) devices are disposed on the riser and are configured to control fluid communication through the internal passage of the riser. The riser manifold is disposed on the riser and comprises: at least one first mechanical connector disposed thereon, at least one first flow coupling communicating with the fluid controlled by at least one of the one or more MPD devices, and at least one first control coupling disposed in control communication with the at least one of the one or more MPD devices.

The rig manifold is configured to removably position adjacent the first face of the riser manifold. The rig manifold comprises: at least one second mechanical connector disposed thereon, at least one second flow coupling disposed in fluid communication with the at least one MPD flow line, and at least one second control coupling disposed in control communication with the at least one MPD control line.

The at least one first and second mechanical connectors are configured to mechanically connect together. The at least one second flow coupling is configured to mate with the at least one first flow coupling and is configured to communicate therewith. The at least one second control coupling is configured to mate with the at least one first control coupling and is configured to communicate therewith.

The one or more MPD devices can comprise one or more of a rotating control device, an annular isolation device, and a controllable flow spool valve.

As can be seen, an apparatus of the present disclosure can comprise at least one riser manifold and at least one rig manifold that mate together. Each of the riser and rig manifolds can have at least one mechanical connector, at least one flow coupling, and at least one control coupling to mate together and connect an MPD system on a floating rig to the riser. Additionally, the apparatus can include at least one flow control device disposed on the riser and in flow communication and/or control communication with the at least one riser manifold and its couplings for the MPD system.

According to a present disclosure, a method is disclosed of running a riser from a floating rig to a subsea wellhead. The floating rig has a managed pressure drilling (MPD) system connected to rig lines. The rig lines include at least one MPD flow line for conducting flow and include at least one MPD control line for conducting control. The riser has an internal passage.

The method comprises not necessarily in sequence: positioning one or more MPD devices on the riser, the one or more MPD devices configured to at least partially control flow in the internal passage of the riser; positioning a riser manifold on the riser, connecting at least one first flow coupling on the riser manifold in flow communication with at least one of the one or more MPD devices, and connecting at least one first control coupling on the riser manifold in control communication with at least one of the one or more MPD devices; connecting at least one second flow coupling on a rig manifold to the at least one MPD flow line, and connecting at least one second control coupling on the rig manifold to the at least one MPD control line; and mating the at least one first and second flow couplings in at least one flow connection and mating the at least one first and second control couplings in at least one control connection by manipulating the rig manifold on an arm toward the riser manifold and remotely mating at least one first and second mechanical connectors respectively of the riser and rig manifolds together.

The foregoing summary is not intended to summarize each potential embodiment or every aspect of the present disclosure.

DETAILED DESCRIPTION OF THE DISCLOSURE

Figures 1A, 1B:
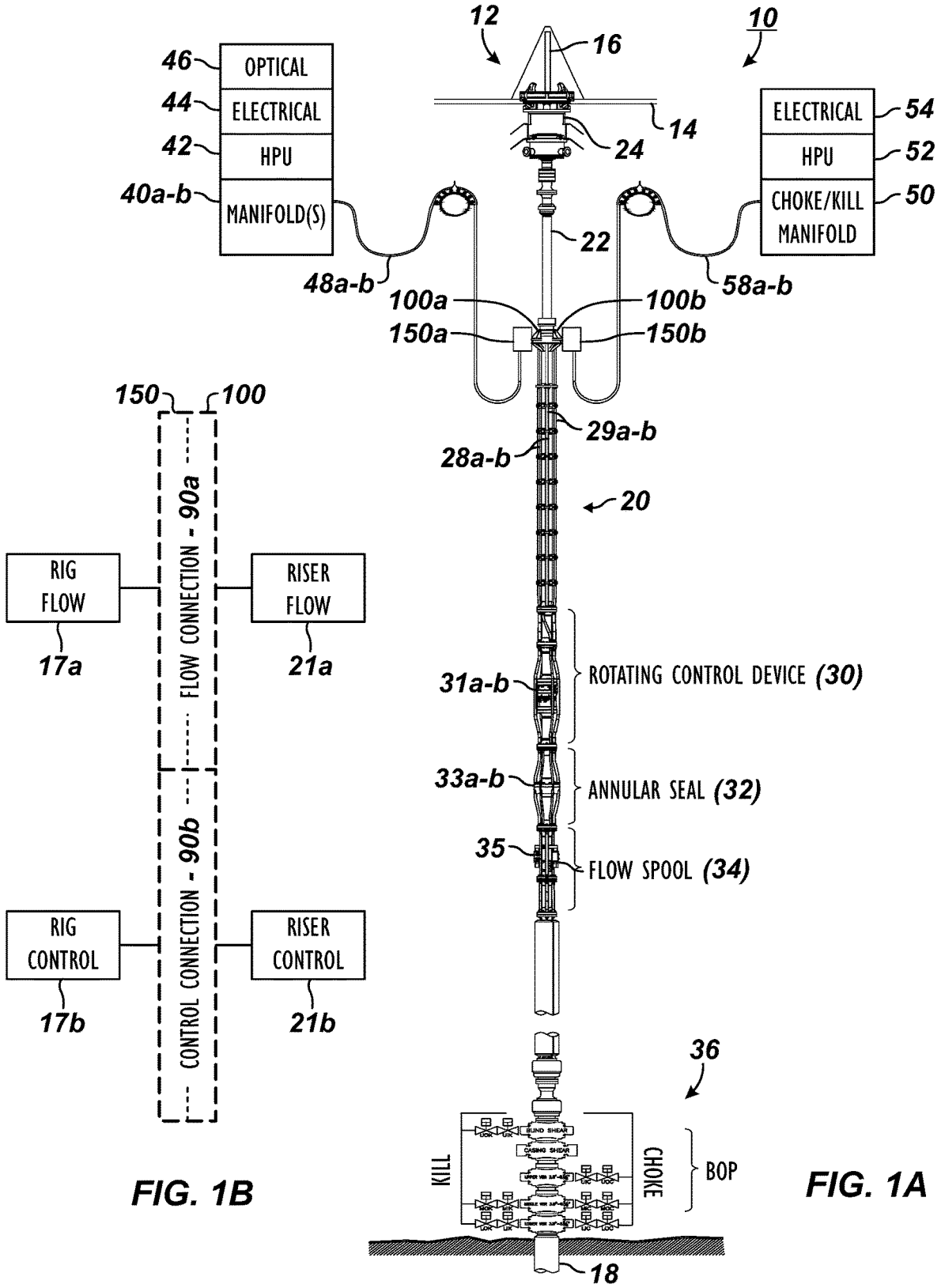
FIG. 1A illustrates a drilling system according to the present disclosure.
FIG. 1B illustrates a schematic view of flow and control connections between rig and riser components of the drilling system.

FIG. 1A diagrams a drilling system 10 according to one embodiment of the present disclosure. As shown and discussed herein, this drilling system 10 can be a closed-loop system for controlled pressure drilling, namely a Managed Pressure Drilling (MPD) system and, more particularly, a Constant Bottomhole Pressure (CBHP) form of MPD system. Although discussed in this context, the teachings of the present disclosure can apply equally to other types of drilling systems, such as conventional drilling systems, other MPD systems (Pressurized Mud-Cap Drilling, Returns-Flow-Control Drilling, Dual Gradient Drilling, etc.) as well as to Underbalanced Drilling (UBD) systems, as will be appreciated by one skilled in the art having the benefit of the present disclosure. For consistency, reference is made to an MPD-type system, which can include any of the above.

The drilling system 10 is depicted for use offshore on a rig 12, such as a floating, fixed, or semi-submersible platform or vessel known in the art, although teachings of the present disclosure may apply to other arrangements. The drilling system 10 uses a riser 20 extending between a diverter 24 on the rig floor 14 to a blow-out preventer (BOP) stack 36 on the sea floor. The riser 20 connects by a riser joint 22 from the diverter 24 and can include one or more flow control devices 30, 32, and 34 disposed on the riser 20. As shown here, the flow control devices 30, 32, and 34 can be disposed on the riser 20 below one or more riser manifolds 100*a-b*, but other configurations are possible. As also shown here, the flow control devices 30, 32, and 34 include a rotating control device (RCD) 30, an annular isolation/sealing device 32, and a flow spool 34 disposed along the length of the riser 20, but other flow control devices for an MPD-type system can be used.

During drilling operations, a drillstring 16 having a bottom hole assembly (BHA) and a drill bit may extend downhole through the riser 20 and into a wellbore 18 for drilling into a formation. The riser 20 can then direct returns of drilling fluids, wellbore fluids, and earth-cuttings from the subsea wellbore 18 to the rig 12. In some conventional forms of operation, the diverter 24 can direct the returns of drilling fluid, wellbore fluid, and earth-cuttings to a mud gas separator (not shown) and other elements to separate out the drilling fluid for potential recycle and reuse, and to separate out gas.

In other forms of operation, such as managed pressure drilling, the one or more flow control devices 30, 32, and 34 are used to direct the returns of drilling fluid, wellbore fluid, and earth-cuttings to elements (i.e., manifolds 40*a-b*) of the rig 12. In other situations, heavy fluids are delivered from elements (i.e., manifold 50) on the rig 12 through kill lines 58*a*, 29*a* to the BOP stack 36 to "kill" the well; the choke lines 29*b*, 58*b* can deliver flow from the BOP stack 36 to an appropriate kill-choke manifold 50 for well control; the drillstring 16 can be cut by a shear ram in the BOP stack 36; or a choke ram can be closed around the drillstring 16 in the BOP stack 36.

As shown generally in FIG. 1B, one or more rig flow components 17*a* (e.g., manifolds 40*a-b*, 50 of the rig 12) connect to one or more riser flow components 21*a* (e.g., the rotating control device 30, the annular isolation device 32, the flow spool 34, the BOP stack 36, etc.) through one or more flow connections 90*a* of the mating manifolds (100, 150). Likewise, one or more rig control components 17*b* (e.g., elements 42, 44, 46, 52, and 54 of the rig 12) connect to one or more riser control components 21*b* (e.g., of the rotating control device 30, the annular isolation device 32, the flow spool 34, the BOP stack 36, etc.) through one or more control connections 90*b* of the mating manifolds (100, 150).

As discussed below, rig lines 48*a-b*, 58*a-b* of the rig 12 in FIG. 1A include flow lines 48*a*, 58*a* for conducting flow in flow connections (90*a*) and include control lines 48*b*, 58*b* for conducting control in control connections (90*b*). These lines 48*a-b*, 58*a-b* are described as including MPD rig lines 48*a-b* configured for separate connection with respective manifolds 100*a*, 150*a* for managed pressure drilling (MPD)-type connections and are described as including kill-choke rig lines 58*a-b* configured for separate connection with respective manifolds 100*b*, 150*b* for kill-and-choke-type connections. The manifolds 100*a-b*, 150*a-b* may connect on the riser 20 at the same level and at different sides thereof. Such an arrangement can help with organization of the drilling system 10. As will be appreciated with the benefit of the present disclosure, however, other arrangements for the rig lines 48*a-b*, 58*a-b* and the manifolds 100*a-b*, 150*a-b* are possible.

As shown in particular in FIG. 1A, rig components (40*a-b*, 42, 44, 46) for managed pressure drilling connect with the rotating control device 30, the annular isolation device 32, the flow spool 34, other components, sensors, and the like on the riser 20 using the MPD rig lines 48*a-b*, which extend from the rig components (e.g., manifolds 40*a-b*, hydraulic elements 42, electrical elements 44, optical elements 46, and the like) on the rig 12 and connect with a first rig manifold 150*a* to a first of the riser manifolds 100*a* disposed on the riser 20. In general, the rig lines 48*a-b* can include flow hoses, hydraulic lines, electric cables, umbilicals, etc. For example, flow lines 48*a* can connect flow from the riser 20, the rotating control device 30, the annular seal device 32, and the flow spool 34 to one or more manifolds 40*a-b* on the rig 12. Also, electrical and hydraulic elements or controls 42 and 44 can connect by control lines 48*b* to the rotating control device 30, the annular seal device 32, and the flow spool 34 to control their operation. For example, control lines 48*b* can carry supply and/or return of hydraulic fluid to and from the devices 30, 32, and 34 for their operation and can carry control or sensor signals with these components.

As noted above, the flow control devices 30, 32, and 34 can have flow connection(s) (90*a*) that communicate MPD flow through the mated manifolds 100*a*, 150*a* with the rig's MPD components 40*a-b*. For example, the riser 20 can have riser flow line(s) 28*a* that are run along the riser 20 from the riser manifold 100*a* to the devices 30, 32, and 34. For example, the rotating control device 30 can have a flow connection that allows flow of drilling fluids up the annulus of the riser 20 to be diverted from the flow connection of the rotating control device 30 to the riser flow line(s) 28*a* connected to the riser manifold 100*a*. In another example, the flow spool 34 can have a plurality of valves 35 for controlling flow of fluid in/out of an internal passage through the riser 20 and can connect to the riser manifold 100*a*. In this way, the flow spool 34 can allows flow of drilling fluids up the annulus of the riser 20 that have been diverted by the rotating control device 30 and the annular isolation device 32 to flow to the rig lines 48*a*.

As also noted above, the flow control device 30, 32, and 34 can have control connection(s) (90*b*) that communicate MPD controls through the mated manifolds 100*a*, 150*a* with the rig's MPD components 42, 44, 46. For example, the riser 20 can have control line(s) 28*b* that are run along the riser 20 from the riser manifold 100*a* to the devices 30, 32, and 34. In particular, the rotating control device 30, the annular isolation device 32, or the flow spool 34 can have hydraulic connections to receive hydraulic controls from the riser manifold 100*a* and riser control line(s) 28*b*, and these devices 30, 32, and 34 can have electrical connections or other control connections to communicate with actuators, sensors, and the like.

For instance, the rotating control device 30, which can include any suitable pressure containment device, keeps the wellbore 18 in a closed-loop at all times while the wellbore 18 is being drilled. To do this, the rotating control device 30 sealingly engages (i.e., seals with an annular rotating seal 31*a* against) the drillstring 16 passing in the riser 20 so contained and diverted annular drilling returns can flow through the mated manifolds 100*a*, 150*b*, which in turn connect to downstream flow components 40*a-b* on the rig 12. In this way, the rotating control device 30 can complete a circulating system to create the closed-loop of incompressible drilling fluid.

The annular isolation device 32 can be used to sealingly engage (i.e., seal with an annular isolation seal 33*a* against) the drillstring 16 or to fully close off the riser 20 when the drillstring 16 is removed so fluid flow up through the riser 20 can be prevented. Typically, the annular isolation device 32 can use a sealing or isolation element 33*a* that is closed radially inward by hydraulically actuated pistons 33*b* or by other form of actuator. Control lines 28*b* on the riser 20 from the riser manifold 100*a* can be used to deliver controls to the annular isolation device 32.

The flow spool 34 can include a number of controllable valves 35 that connect the internal passage of the riser 20 to flow lines 28*a* on the riser 20, which connect to the riser manifold 100*a*. Control lines 28*b* on the riser 20 connected to the riser manifold 100*a* may also be used to deliver controls to open and close the controllable valves 35 of the flow spool 34.

The rig's MPD flow components (17*a*) can include a buffer manifold 40*a* and a choke manifold 40*b*. The buffer manifold 40*a* connects by the flow connections (90*a*) of the manifolds 100*a*, 150*a* from the rotating control device 30, the annular isolation device 32, and the flow spool 34 and receives flow returns during drilling operations. Among other components, the buffer manifold 40*a* may have pressure relief valves (not shown), pressure sensors (not shown), electronic valves (not shown), and other components to control operation of the buffer manifold 40*a*.

The choke manifold 40*b* is typically downstream from the buffer manifold 40*a*. The choke manifold 40*b* can produce surface backpressure to perform managed pressure drilling with the drilling system 10 and can measure parameters of the flow returns. Among other components, for example, the choke manifold 40*b* may have flow chokes (not shown), a flowmeter (not shown), pressure sensors (not shown), a local controller (not shown), and the like to control operation of the choke manifold 40*b*.

During operations, for example, the drillstring 16 passing from the rig 12 can extend through the riser 20 and through the BOP stack 36 for drilling the wellbore 18. As the drillstring 16 is rotated, the rotating control device 30 seals the annulus between the drillstring 16 and the riser 20 to conduct a managed pressure drilling operation. To do this, the rotating control device 30 includes one or more seals 31*a* to seal the annulus around the drillstring 16 passing through the riser's internal passage. The rotating control device 30 can also include actuators, sensors, valves, or other control components 31*b* that connect through control connections (90*b*) of the manifolds 110*a*, 150*a* to rig controls (17*b*), such as a hydraulic pressure unit 42, electrical sensor components 44, etc. In this way, flow returns having drilling fluid, wellbore fluid, and cuttings flow up through the annulus between the drillstring 16 and the riser 20 to the rotating control device 30, which diverts the flow returns through the flow connections (90*a*) to the buffer manifold 40*a*, then to the choke manifold 40*b*, and further on to additional rig components, such as mud gas separator, trip tanks, mud pumps, mud standpipe manifold, standpipe flow line, etc. to finally be pumped down the drillstring 16.

The drilling system 10 identifies downhole influxes and losses during drilling, for example, by monitoring circulation to maintain balanced flow for constant BHP under operating conditions and to detect kicks and lost circulation events that jeopardize that balance. The system 10 measures the flow-in and flow-out of the well and detects variations. In general, if the flow-out is higher than the flow-in, then fluid is being gained in the system 10, indicating a kick. By contrast, if the flow-out is lower than the flow-in, then drilling fluid is being lost to the formation, indicating lost circulation. To maintain balance, the system 10 can adjust surface backpressure with the choke manifold 40*b*.

In some situations, an uncontrolled release of wellbore fluids (e.g. high-pressure liquid and/or gas streams) may occur during drilling. The riser 20 with its rotating control device 30, annular isolation device 32, and flow spool 34 can then be configured to divert the uncontrolled wellbore fluid flow in a controlled fashion as described above.

In still other situations, the well must be "killed" or otherwise controlled through well control operations. As shown in FIG. 1A, rig components (50, 52, 54) for well control (e.g., kill-choke) connect with the BOP stack 36 and other components, sensors, or the like using the second rig lines 58*a-b*, which extend from the rig components 17*a-b* (e.g., manifolds 50, hydraulic controls 52, electrical controls 54, and the like) on the rig 12 and connect with a second rig manifold 150*b* to a second of the riser manifolds 100*b* disposed on the riser 20. In general, the rig lines 58*a-b* can include flow hoses, hydraulic lines, electric cables, umbilicals, etc. For example, electrical and hydraulic controls 54, 56 can connect by control lines 58*b* to the BOP stack 36 to control its operation. For example, the control lines 58*b* can carry supply and/or return of hydraulic fluid to and from the BOP stack 36 for its operation. Kill and choke lines 58*a* can connect a choke & kill manifold 50 to the BOP stack 36.

As noted, the BOP stack 36 can have flow connection(s) (90*a*) that communicate kill-choke flow through the mated manifolds 100*b*, 150*b* with the rig's kill-choke components 50. For example, the riser 20 can have kill and choke lines 29*a-b* running along the riser 20 from the riser manifold 100*b* to the BOP stack 36 and its components to direct flow and control for kill-choke operations.

The drilling system 10 can be used to control operations of the BOP stack 36, which may have one or more annular or ram-style blow out preventers. For example, the kill line 29*a* can deliver heavy fluid through kill lines 58*a*, 29*a* to the BOP stack 36 to "kill" the well, and the choke lines 29*b*, 58*b* can deliver flow from the BOP stack 36 to an appropriate kill-choke manifold 50 for well control. The drillstring 16 can be cut by a shear ram in the BOP stack 36, or a choke ram can be closed around the drillstring 16 in the BOP stack 36. In addition to kill and choke, the lines 29*a-b* may include conduits or lines for controlling hydraulic valves and connections in the BOP stack 36, and there may be "booster" lines for injecting fluid.

In addition to the connections outlined above, the lines 48*a-b*, 58*a-b* can connect to other components on the drilling system 10, such as glycol injection equipment. Thus, connections can be provided for a boost connection, a glycol injection connection, a hot connection, a spare connection, and a pumped riser connection. In addition to all of these components, the drilling system 10 also includes mud pumps, mud tanks, a mud standpipe manifold for a standpipe, a mud gas separator, a control system, and various other components (not shown). During drilling operations, these components can operate in a known manner.

The rig manifolds 150*a-b* consolidate the connections of the all of the various rig lines 48*a-b*, 58*a-b* from the rig 12 to the components on the riser 20 and any riser lines 28*a-b*, 29*a-b* on the riser 20 when lowering the riser 20, rotating control device 30, annular isolation device 32, flow spool 34, and other components from the rig 12 into the sea below. The riser lines 28*a-b*, 29*a-b* are typically preinstalled on the riser 20 to extend from the riser manifolds 100*a-b* to the various components 30, 32, 34, 36, etc. and carry the electric, hydraulic, and flow needed for operation. Rather than individually and manually connecting each of the various lines 48*a-b*, 58*a-b* to the rotating control device 30, annular isolation device 32, flow spool 34, and the like when lowering the riser 20 from the rig 12, the rig manifolds 150*a-b* remotely connect the rig lines 48*a-b*, 58*a-b* to the riser manifolds 100*a-b* on the riser 20 using an automated arm assembly, as discussed below.

Figure 2A:
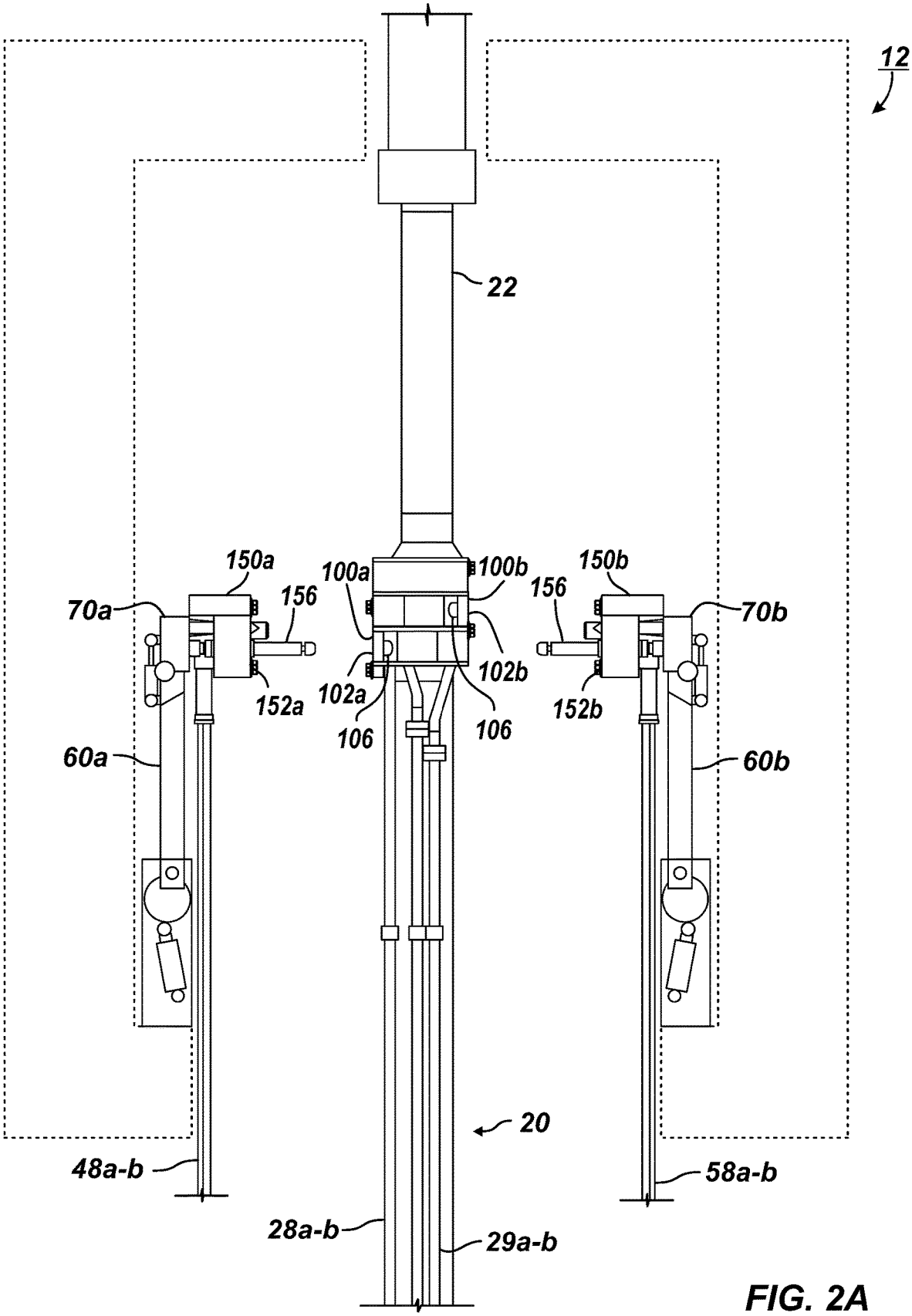
FIGS. 2A-2C illustrate operation of arm assemblies installing rig manifolds for rig lines to a riser manifold on a riser below a rig.
Figure 2B:
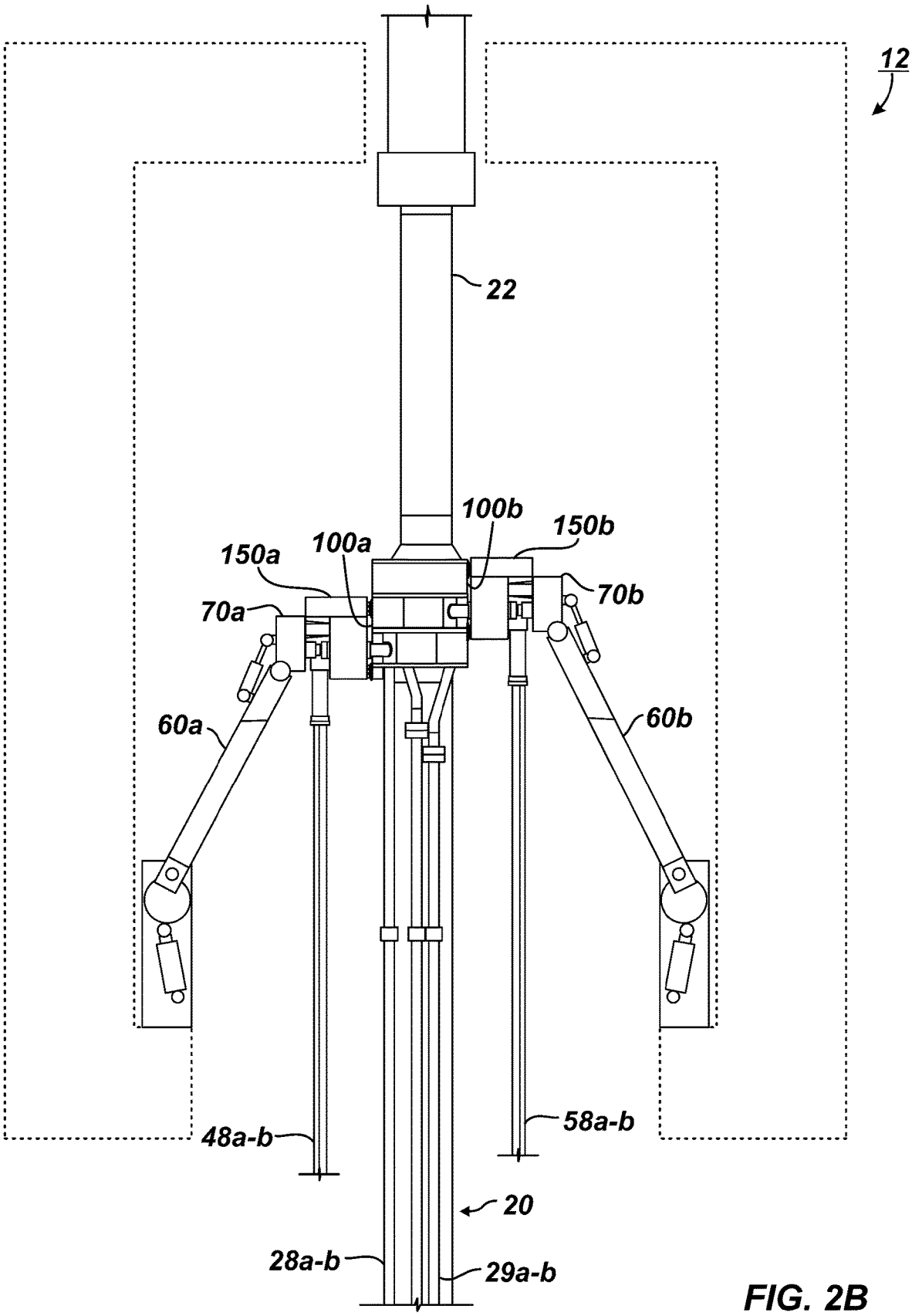
Figure 2C:
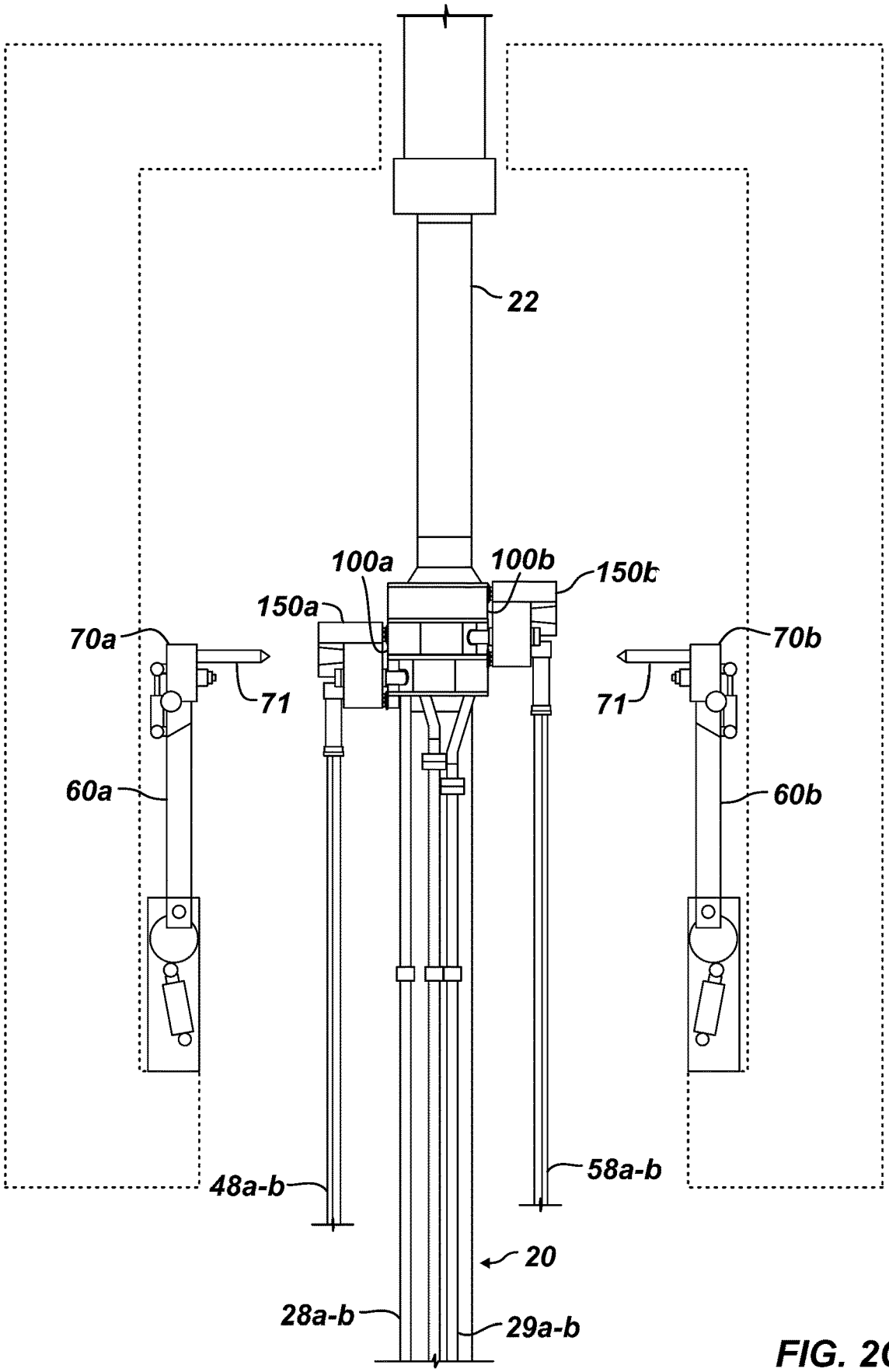

FIGS. 2A-2C illustrate operation of arm assemblies installing rig manifolds 150*a-b* for the rig lines 48*a-b*, 58*a-b* to riser manifolds 100*a-b* on the riser 20 below the rig 12. In FIGS. 2A-2C, a cross-section through a moonpool of the rig 12 is shown. The riser 20 hangs from a top drive (not shown) and down through the opening in the drilling deck and the diverter housing and extends further down to the BOP stack (not shown) that hangs a desired elevation above the wellhead's depth.

At this point in the deployment, the BOP stack (36), the sections of the riser 20, the flow control devices (30, 32, and 34), and the like have all been assembled and deployed from the rig 12. Operators have also installed the riser manifolds 100*a-b* on the riser 20 and have connected the riser lines 28*a-b*, 29*a-b* to the riser manifolds 100*a-b*. In subsequent stages, opposing rig manifolds 150*a-b* are used to connect the rig lines 48*a-b*, 58*a-b* to the riser manifolds 100*a-b*. In general, implementations may have one or more rig manifolds 150*a-b*, and the multiple manifolds 150*a-b* may or may not be opposing one another. The rig lines 48*a-b*, 58*a-b* include at least one rig flow line 48*a*, 58*a* for conducting flow and include at least one rig control line 48*b*, 58*b* for conducting control. The riser lines 28*a-b*, 29*a-b* include at least one riser flow line 28*a*, 29*a* for conducting flow and include at least one riser control line 28*b*, 29*b* for conducting control.

The riser manifolds 100*a-b* are disposed on the riser 20 and have faces 102*a-b* on opposing sides of the riser 20. Each of the faces 102*a-b* has at least one first mechanical connector 106 disposed thereon, at least one first flow coupling (not shown), and at least one first control coupling (not shown). The at least one first flow coupling is disposed in fluid communication with at least one of the riser flow lines 28*a*, and the at least one first control coupling is disposed in control communication with at least one of the riser control line 28*b*.

Each of the rig manifolds 150*a-b* has another face 152*a-b* that removably positions adjacent one of the faces 102*a-b* of the riser manifolds 100*a-b*. Each of the faces 152*a-b* has at least one second mechanical connector 156 disposed thereon, at least one second flow coupling (not shown), and at least one second control coupling (not shown). The at least one second flow coupling is disposed in fluid communication with the at least one rig flow line 48*a*, 58*a*, and the at least one second control coupling is disposed in control communication with the at least one rig control line 48*b*, 58*b*.

Either of the manifolds 100*a-b*, 150*a-b* can have male and/or female elements for coupling and mating together. Preferably, however, the rig manifolds 150*a-b* include male elements (i.e., guide pins, pipe nipples, and couplings) for engaging in female elements (i.e., guide sleeves, pipe receptacles, and couplings) of the riser manifolds 100*a-b* because the rig manifolds 150*a-b* are manipulated relative to the riser manifolds 100*a-b*. Additionally, the riser manifolds 100*a-b* preferably have the female elements so that less structure extends externally outside the circumference around the riser 20, which could become damaged while manipulating and lowering the riser 20.

As shown in FIG. 2A, the first and second horizontally-directed rig manifolds 150*a-b* with the rig lines 48*a-b*, 58*a-b* from opposing sides of the platform are arranged on the skid and are arranged for being guided into two corresponding and oppositely directed horizontally directed faces 102*a-b* on the riser manifolds 100*a-b* disposed on the riser's slip joint outer barrel. For example, the rig manifold 150*a* on the left side of the drawing can be used for the rig lines 48*a-b* of the MPD components, such as the buffer/control manifolds (40*a-b*), the hydraulic power units (42), the electrical/optical controls (44, 46), the rotating control device (30), the annular isolation device (32), and the flow spool (34), as discussed above. The rig manifold 150*b* in the right part of the drawing can be used for the kill and choke lines 58*a-b* of the kill-choke components, such the kill-choke manifolds (50), the hydraulic power units (52), the electrical/optical controls (54, 56) and the BOP stack (36), as discussed above.

As shown in FIG. 2A, a slip joint on top of the riser 20 has an outer barrel 22 on which the riser manifolds 100*a-b* are arranged. The rig manifolds 150*a-b* are supported with manipulator heads 70*a-b* on manipulator arms 60*a-b*, and the flexible rig lines 48*a-b*, 58*a-b* from components on the rig 12 connect to the rig manifolds 150*a-b*. The manipulator arms 60*a-b* extend from the drilling platform and are manipulated to move the rig manifolds 150*a-b* in a generally horizontal direction to connect to the riser manifolds 100*a-b*. In this way, connections can be established between the rig lines 48*a-b*, 58*a-b* to the MPD, kill-choke components on the riser 20 and any riser lines 28*a-b*, 29*a-b* on the riser 20.

The heads 70*a-b* on the manipulator arms 60*a-b* have releasable connecting mechanisms (71; FIG. 2C) to the rig manifolds 150*a-b* for releasing the manipulator arms 60*a-b* from the rig manifolds 150*a-b* after the rig manifolds 150*a-b* have been connected to riser manifolds 100*a-b*. Additional details of the manipulator arms 60*a-b*, the heads 70*a-b*, and the like can be found in U.S. Pat. No. 8,875,793, which is incorporated herein by reference in its entirety.

FIG. 2B shows the rig manifolds 150*a-b* displaced inwards in horizontal directions and "stabbed" into the riser manifolds 100*a-b* on the riser 20. For each, the at least one mechanical connector 156 of the rig manifold 150*a-b* is mechanically connected to the at least one mechanical connector 106 of the riser manifold 100*a-b*. The at least one flow coupling of the rig manifold 150*a-b* is mated with the at least one flow coupling of the riser manifold 100*a-b* for conducting flow, and the at least one control coupling of the rig manifold 150*a-b* is mated with the at least one control coupling of the riser manifold 100*a-b* for conducting control.

The manipulator arms 60*a-b* can be telescoping and/or pivoting and can be provided with links and hydraulics allowing the rig manifold 150*a-b* to be displaced when held in a desired position and elevation relative to the riser 20. The arms 60*a-b* may follow the riser's pendulum movement and possible small vertical movements. For example, the arms 60*a-b* may each include a ball link on the manipulator arm's end and may include telescopic function to allow the arm 60*a-b* to move with pendulum movements of the riser 20 while the rig manifold 150*a-b* is in its connected state.

Additionally, the heads 70*a-b* can be positioned on spherical bearings, allowing side-to side yaw movement to accommodate misalignment of the riser 20. For example, the head 70*a-b* can be misaligned up to 20 degrees either side. As soon as one guide post 156 catches, the system aligns itself for a successful stab.

When an interconnection has been achieved, this flexibility of the arms 60*a-b* and heads 70*a-b* allows the operations both for connecting (and later disconnecting) to be conducted in an orderly and controlled manner. This may also allow operations to extend the weather window for when to commence, conduct or continue riser operations and thus provide an economical advantage for the drilling rig 12 in addition to the time saving that the invention's method provides to the operation.

When the manipulator arm 60*a-b* has brought the rig manifold 150*a-b* into a secure engagement with the riser manifold 100*a-b*, the hydraulics of the manipulator arm 60*a-b* may be set to idle so the manipulator arm 60*a-b* can follow the riser's movements. The hydraulic system for the manipulator arm 60*a-b* may not be activated until the releasable connector device (71) of the arm's head 70*a-b* has been disconnected and retracted from the rig manifold 150*a-b*. For example, the rig manifold 150*a-b* has cam-locks on the guide posts 154. Once the cam-locks are locked, the arms 60*a-b* release the heads 70*a-b* from the rig manifolds 150*a-b*.

FIG. 2C shows a subsequent step with the releasable connector devices 71 on the manipulator arms' heads 70 released from the rig manifolds 150*a-b*, which remain connected to the riser manifolds 100*a-b* on the riser 20. Connections have now been established from the rig's lines 48*a-b*, 58*a-b* to the riser's components and line 28*a-b*, 29*a-b* via the rig manifolds 150*a-b* and the riser manifolds 100*a-b*.

Once the connections have been completed, further operational steps can be performed. For example, the riser 20 can be lowered from the rig 12 to land the BOP stack on the wellhead. The riser's load can be connected to tension line compensators, and the top of the inner barrel (not shown) can be connected to a flex joint and further up to a diverter housing.

Again and as noted previously, the manifolds 100*a-b*, 150*a-b* may connect on the riser 20 at the same level and at different sides, such as described in FIGS. 2A-2C. Such an arrangement can help with organization of the system. As will be appreciated with the benefit of the present disclosure, however, other arrangements are possible. For example, the manifolds pairs 100*a*, 150*a* and 100*b*, 150*b* may connect on the riser 20 at different levels and can be disposed at the same side so that one arm assembly can be used at different times in the installation process to install each of the rig manifolds 150*a-b* to its respective riser manifold 100*a-b*.

Figure 3:
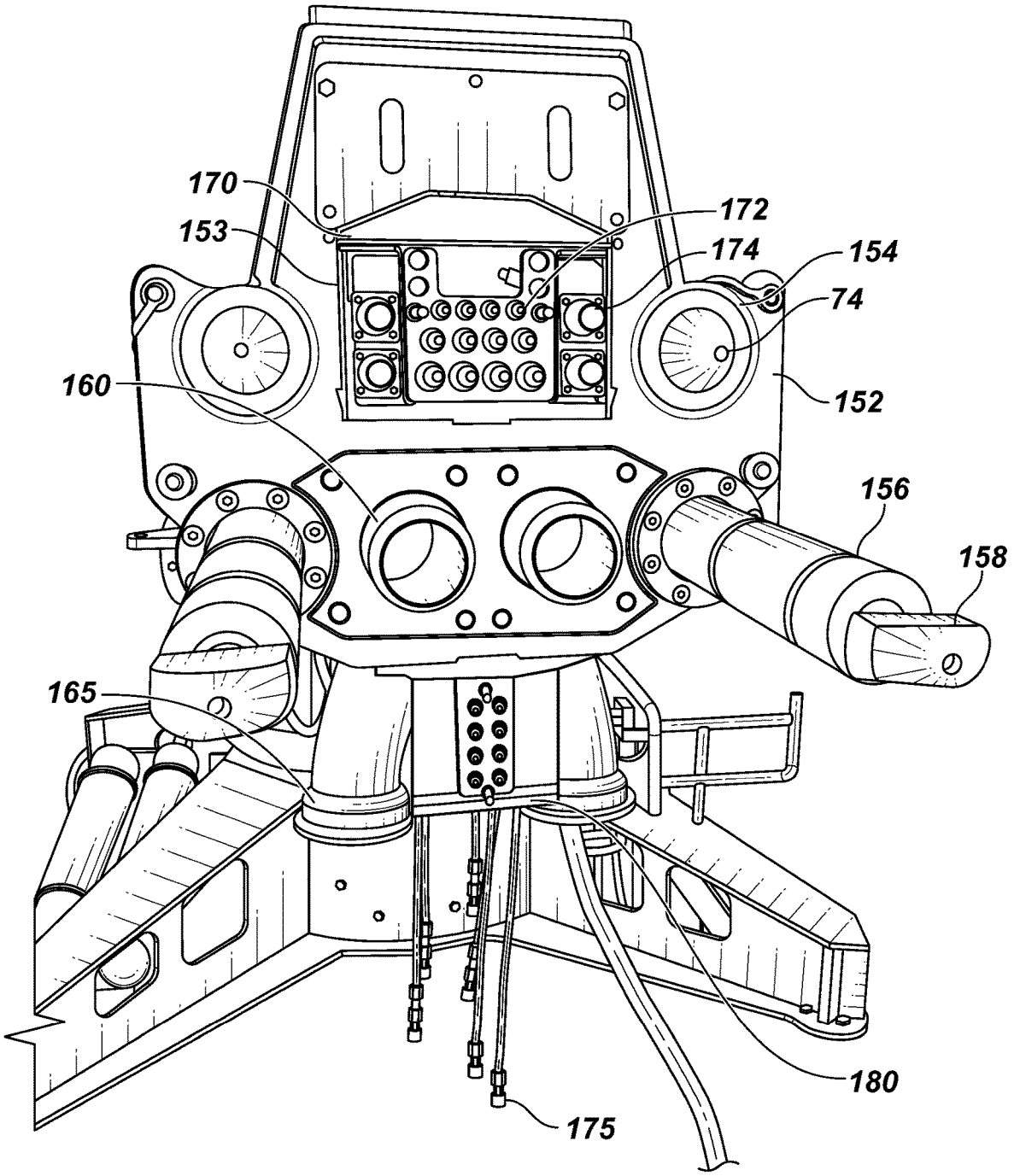
FIG. 3 illustrates a front view of a rig manifold according to the present disclosure.

Turning to FIG. 3, the front view of a rig manifold 150 according to the present disclosure is shown in more detail disposed on a head 70 of a manipulator arm 60. The manifold 150 includes a front face 152 having support slots 154 for insertion on the carry posts 74 of the head 70. The carry posts 74 extending slightly from the face 152 can help center and align the manifold 150 when it is brought against the riser manifold (not shown).

The mechanical connector on the rig manifold 150 includes a pair of guide posts 156 extending from the face 152 of the rig manifold 150. As disclosed herein, the guide posts 156 are arranged to be guided into guide sleeves (106) of the riser manifold (100). The guide posts 156 include locking heads or cam locks 158 with profiles that engage locking profiles in the guide sleeves (106) and are rotated and thereby locked.

The flow coupling of the rig manifold 150 includes a pair of pipe nipples 160 extending from the face 152. The pipe nipples 160, which can extend in between the guide posts 156, communicate internally with flange connections 165 for the riser flow lines (48*a*, 58*a*) disposed on the bottom of the rig manifold 150.

The control coupling of the rig manifold 150 can be installed directly in the face 152, or the rig manifold 150 can include stab or mating plates 170, 180 having control couplings. In general, the control couplings can include one or more of a male electrical coupling, a male hydraulic coupling, and a male fiber optic coupling. In particular, an upper stab plate 170 having control couplings can be disposed on the manifold 150 at the face 152. As shown here, the upper stab plate 170 can be disposed within a cavity 153 of the face 152. The upper stab plate 170 can float for adjustment in the cavity 153 when engaging a complimentary mating plate of the riser manifold (100) as discussed below. For example, the upper stab plate 170 may fit within the cavity 153 and may be held by pins, springs, and the like so it can shift relative to the face 152.

The upper stab plate 170 includes a plurality of control couplings 172, 174—each preferably male. For example, some of the male control couplings 172 can be used for electrical, while other of the male control couplings 174 can be used for fiber optic, hydraulic, and other communications. All of the control couplings can be wet-mate, ROV style connectors.

A lower stab or mating plate 180 can be disposed below the face 152. The lower stab plate 180 can also float for adjustment when engaging a complimentary plate of the riser manifold (100). The lower stab plate 180 includes a plurality of couplings 182—each preferably male, which can be used for electrical, fiber optic, hydraulic, and other communications.

Figure 4:
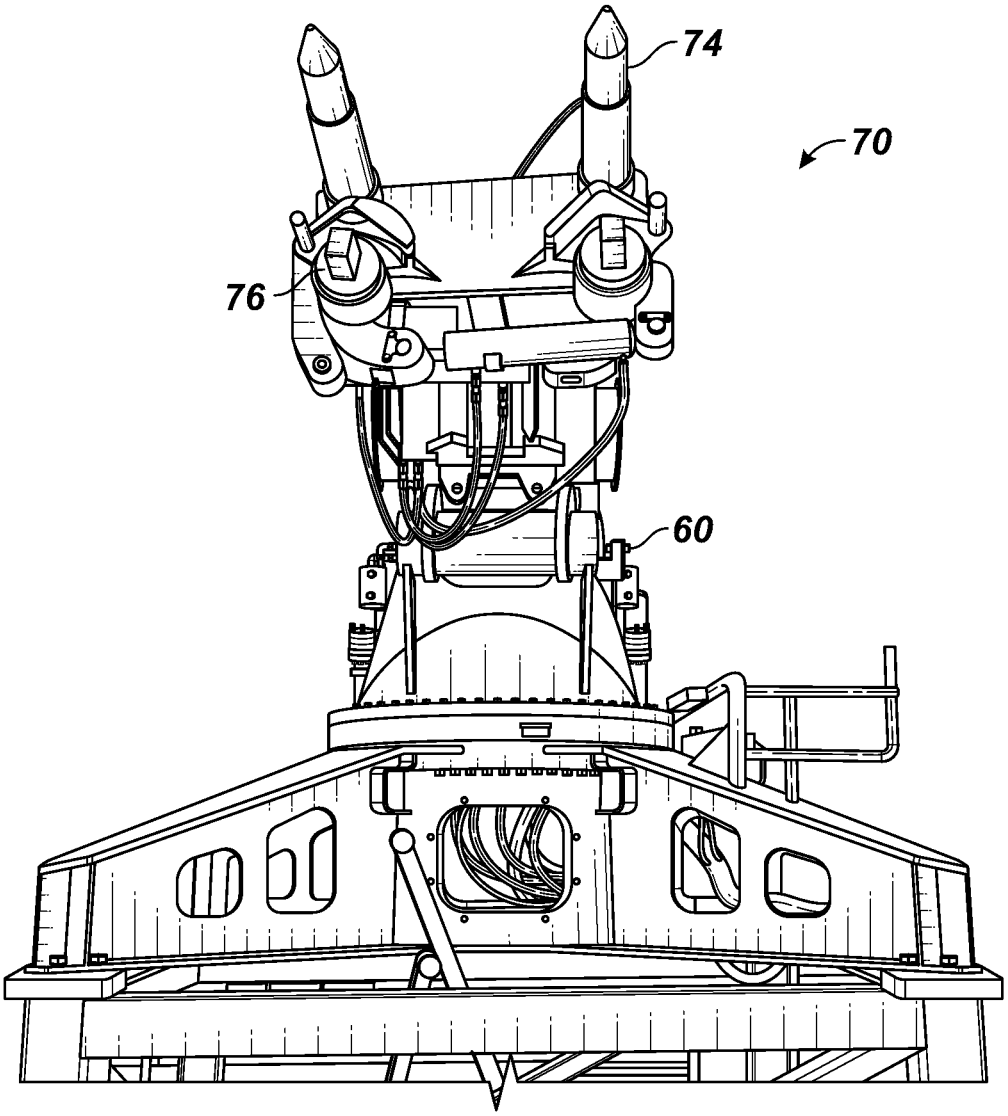
FIG. 4 illustrates a front view of an arm assembly according to the present disclosure.

FIG. 4 illustrates a front view of an arm assembly according to the present disclosure for manipulating the rig manifold (150) of FIG. 3. The assembly includes a head 70 disposed on a manipulator arm 60. The head 70 includes carry posts 74 on which the rig manifold (150) is supported. The carry posts 74 may be non-locking with the rig manifold (150). Guide post keys 76 of the head 70 are rotatable to turn the locks (158) on the guide posts (156) of the rig manifold 150, as described below.

Figure 5A:
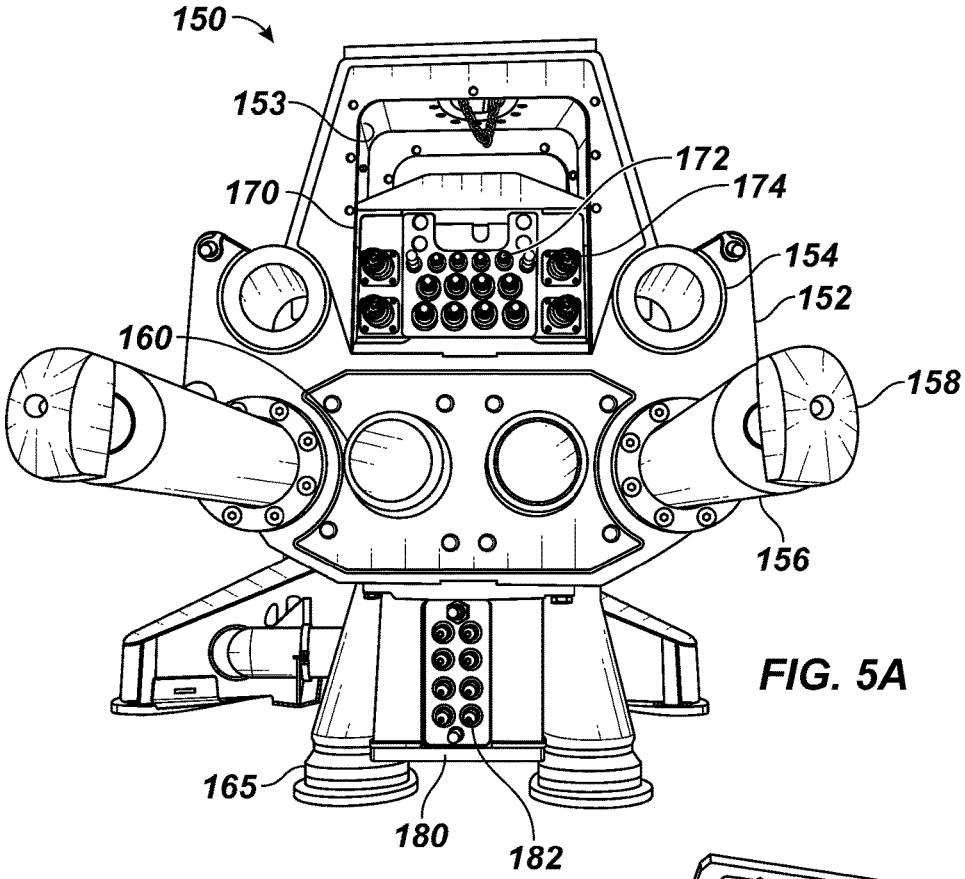
FIGS. 5A-5B respectively illustrate front and back views of the disclosed rig manifold.
Figure 5B:
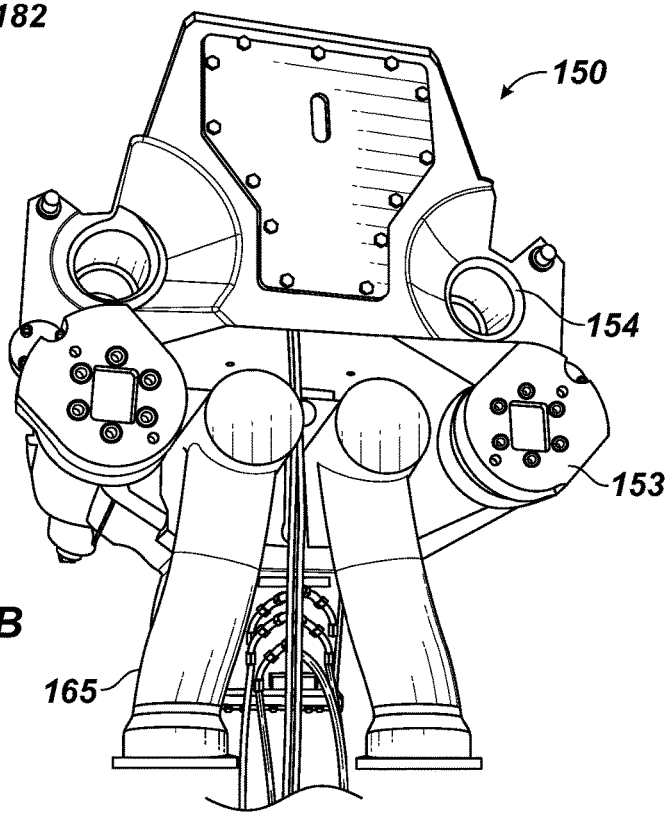

FIG. 5A illustrates the front of a rig manifold 150 independent of the manipulator head (70). The carry slots 154 are shown without the carry posts (74) of the head (70). FIG. 5B illustrates the back of the rig manifold 150. The backs of the carry slots 154 are visible as are the rotary slots 155 for connecting to the guide post keys (76) of the head (70). A back panel may provide access to the interior (153) of the manifold 150 for configuring lines to the front stab plate (170).

Figure 6:
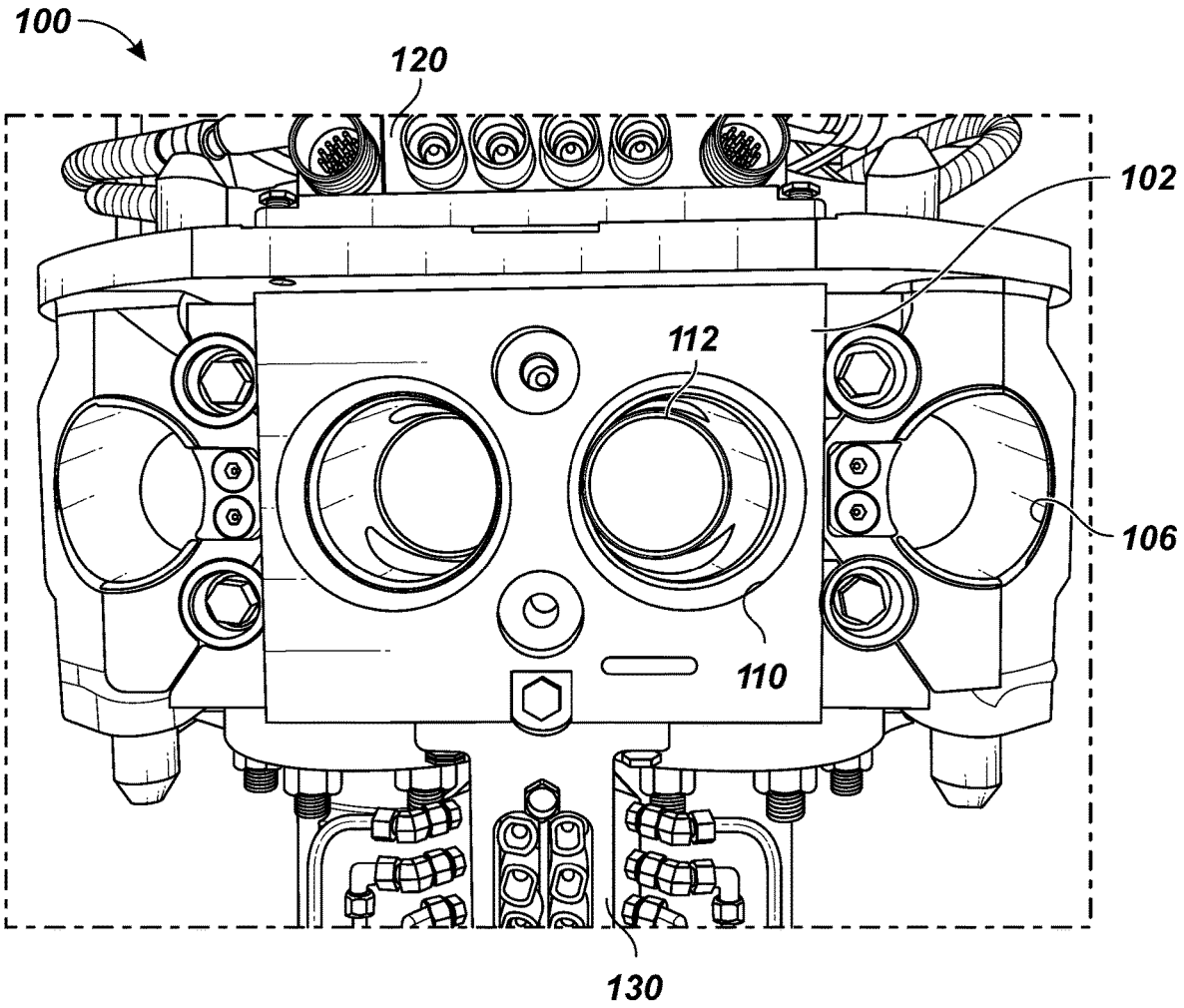
FIG. 6 illustrates a detail of the disclosed riser manifold.

FIG. 6 illustrates a detail of a riser manifold 100. The manifold's mechanical connector includes a pair of guide sleeves 106 defined in the face 102 of the riser manifold 100. The guide sleeves 106 receive the guide posts (156) of the rig manifold (150) when mated together. These sleeves 106 include internal lock or cam surfaces (not shown) to engage the guide posts' locks (158) when rotated.

The flow couplings 110 include female receptacles defined in the face 102 of the riser manifold 100. As disclosed herein, the male nipples (160) of the rig manifold (150) are inserted into the female receptacles 110 to mate the rig flow line(s) (48*a*, 58*a*) in fluid communication with the riser flow line(s) (28*a*, 29*a*). Internally, the receptacles 110 include flow cushions 112 to reduce the velocity of the fluid flow through the receptacles 110 and reduce erosion in the bend of the receptacles 110.

Upper and lower mating plates 120, 130 can be disposed above and below the face 102 for mating with the upper and lower stab plates (170, 180) of the rig manifold (150). The mating plates 120, 130 have control couplings—each preferably female, which can include one or more of a female electrical coupling, a female hydraulic coupling, and a female fiber optic coupling.

Figure 7A:
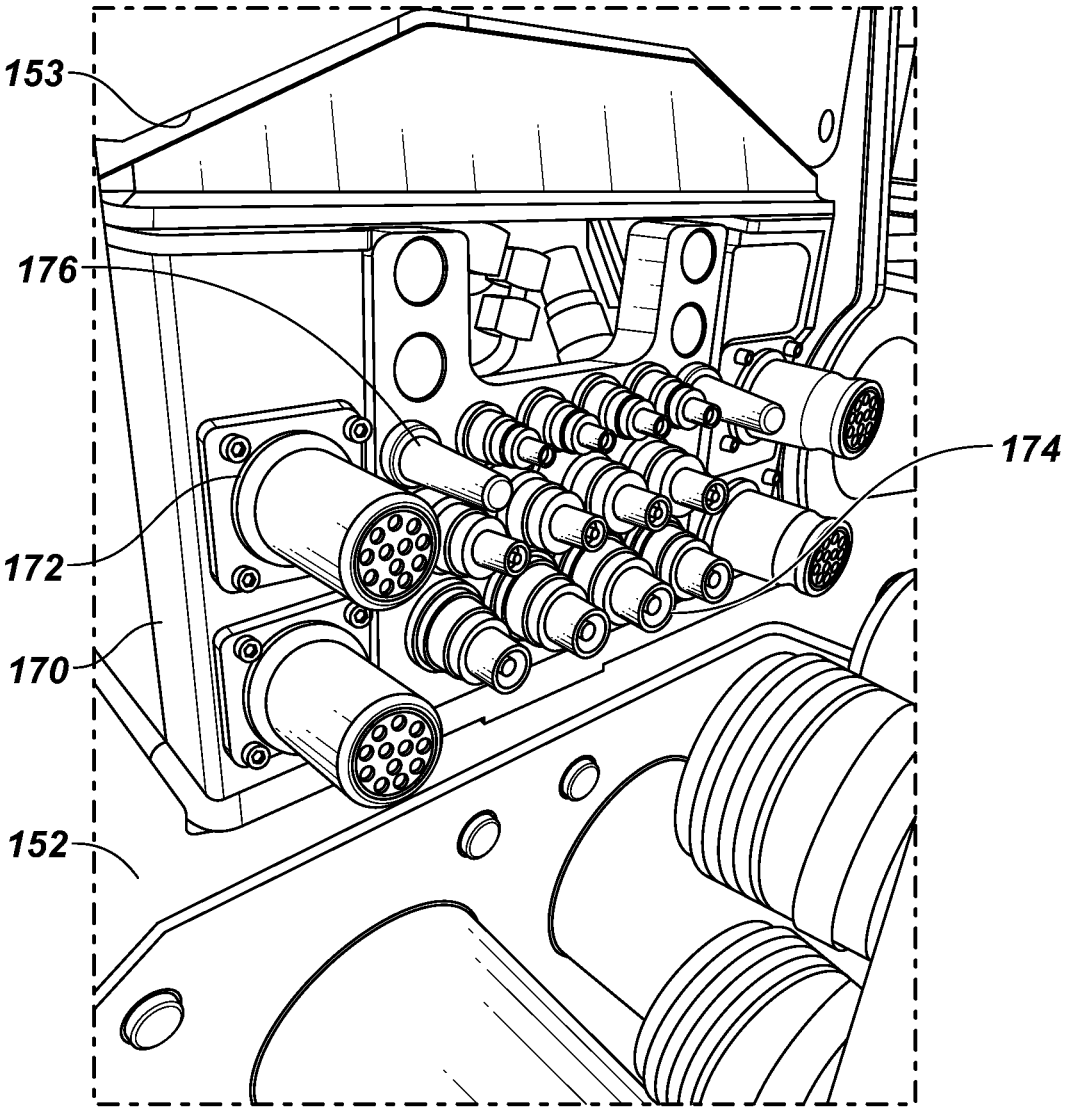
FIGS. 7A-7B illustrate upper control couplings respectively on the disclosed rig and riser manifolds.
Figure 7B:
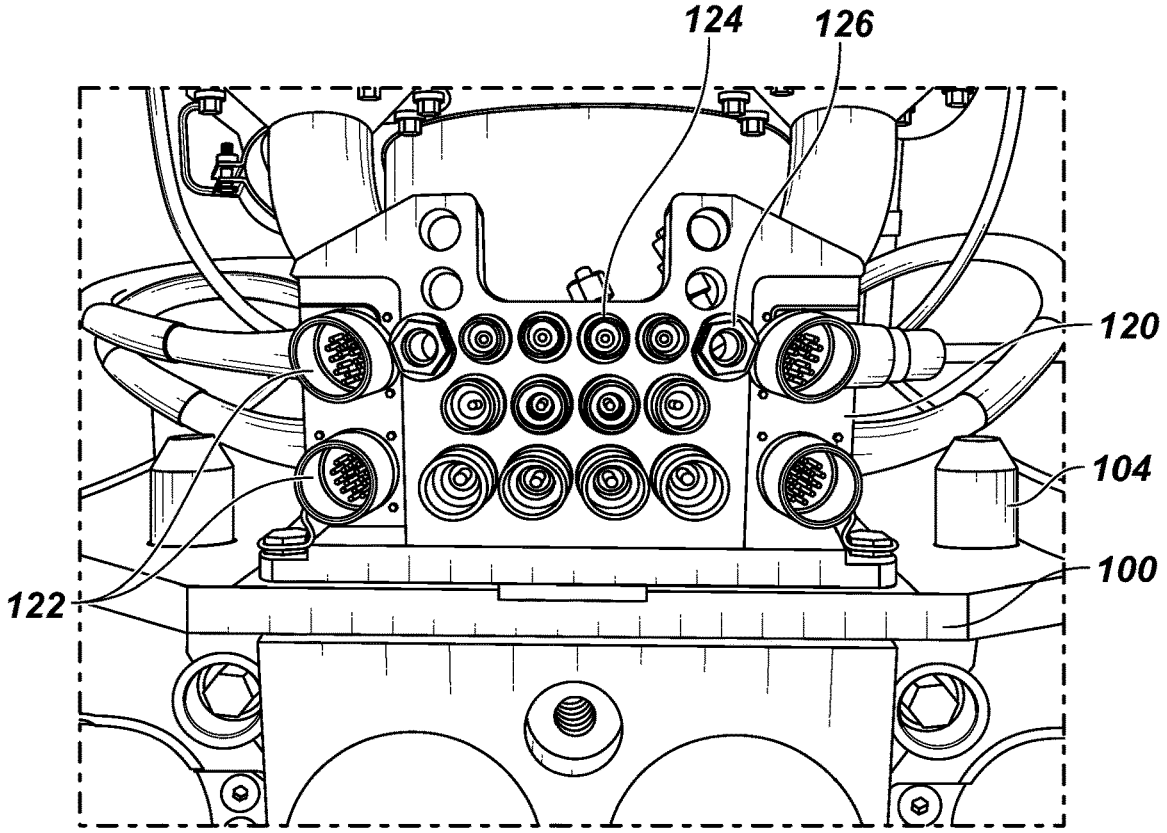

FIG. 7A illustrates a detail of the upper stab plate 170 on the rig manifold 150, and FIG. 7B illustrates a detail of the upper mating plate 120 on the riser manifold 100. The stab plate 170 includes the male couplings 172, 174 with external taper to insert into the female couplings 122, 124 with the internal taper of the mating plate 120. (As will be appreciated, male and female couplings are used respectively on the opposite plates 170, 120, but a reverse configuration could be used. Moreover, each plate 170, 120 can include a mix of male and female couplings.)

Again, the upper stab plate 170 is "floating" to facilitate alignment. Each of the couplings 122, 124/172, 174 are depth-of-engagement tolerant connectors and include tapered male connectors to facilitate alignment and mating with the female connectors. Precision guideposts 176 can be disposed on the stab plate 170 next to male connectors 172, 174 to facilitate alignment and mating.

These control couplings 122, 124/172, 174 can connect electric and hydraulic controls. The electric controls can be used for sensors, cameras, lights, etc. The hydraulic controls can be used for hydraulics to the rotating control device (30), annular seal device (32), etc.

As shown in FIG. 7B, the mating plate 120 on the riser manifold 100 is a fixed panel, but each of the individual couplings 122, 124 may be floating to facilitate fine alignment. Receptacles 126 are disposed on the plate 120 to mate with the precision guideposts 176 on male stab plate 170. These receptacles 126 can be composed of brass.

Figure 8A:
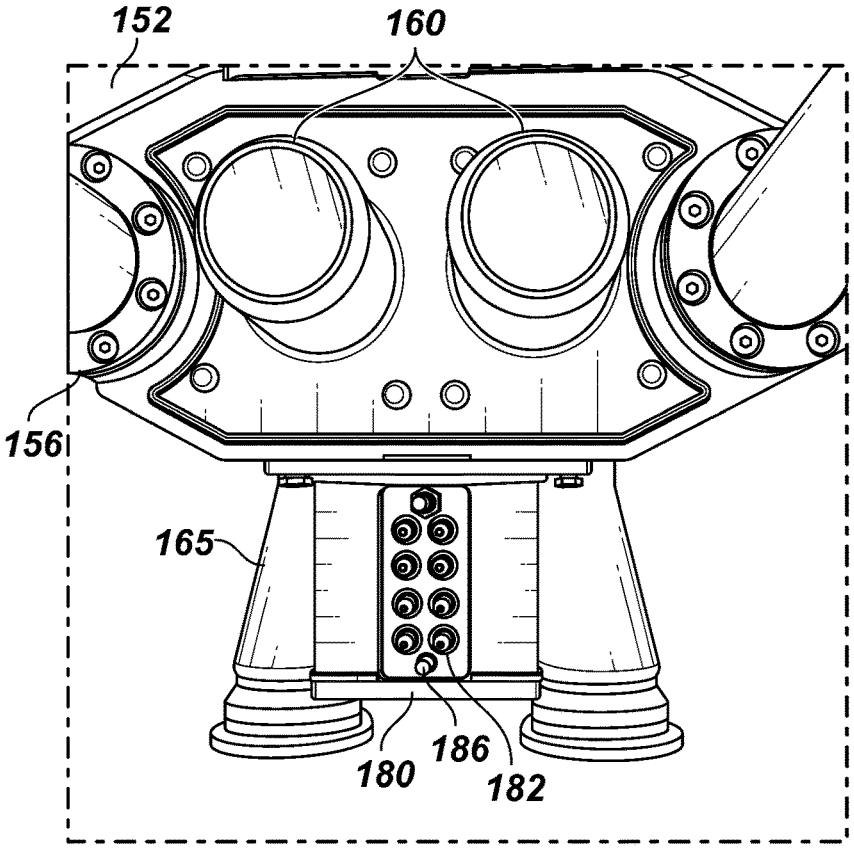
FIGS. 8A-8B illustrate lower control couplings respectively on the disclosed rig and riser manifolds.
Figure 8B:
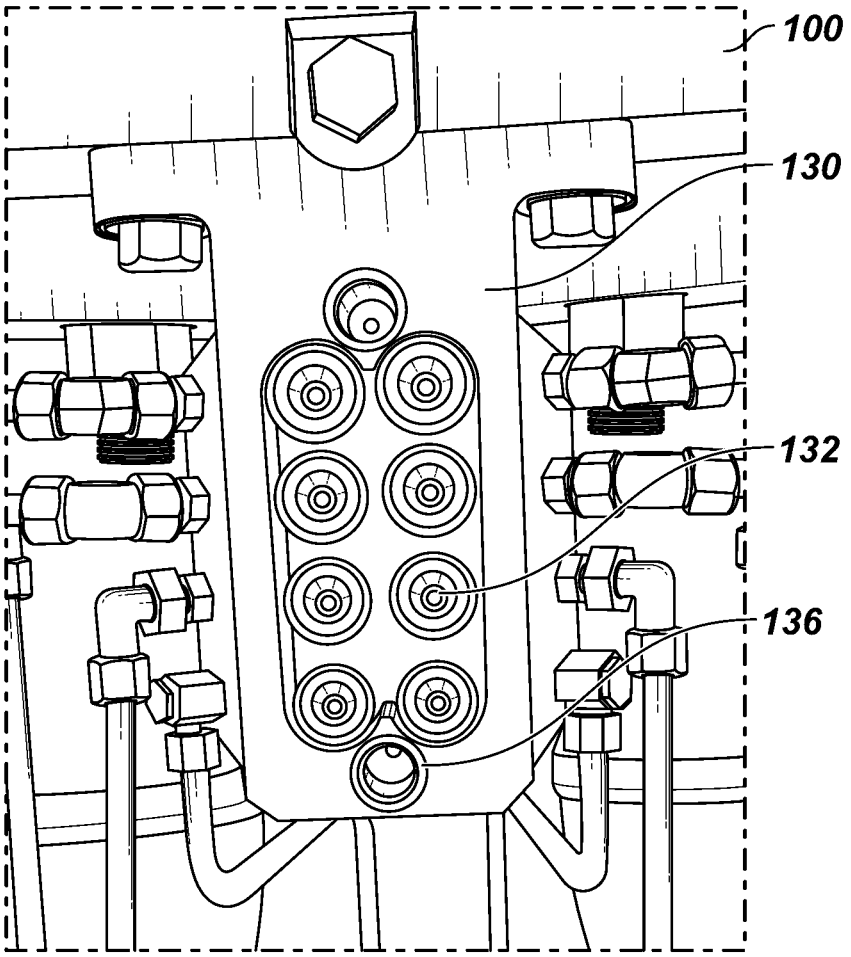

FIG. 8A illustrates a detail of the lower stab plate 180 on the rig manifold 150, and FIG. 8B illustrates a detail of the lower mating plate 130 on the riser manifold 100. The stab plate 180 includes the male couplings 182 with external taper to insert into the female couplings 132 with the internal taper of the mating plate 130.

As with the upper elements discussed above, the lower stab plate 180 is floating and has precision guide posts 186 and male couplings 182. These male couplings 182 can be used for the hydraulic controls, such as for the four valves on the flow spool (36). The corresponding mating plate 130 on the riser manifold 100 is fixed, although the individual couplings 132 may float for fine alignment. Stabbing features are provided similar to those disclosed above, such as tapered, depth-tolerant connectors, guideposts 186, brass receptacles 136, etc.

The engagement sequence of the rig manifold 150 to the riser manifold 100 of FIGS. 3 through 8B involves the main guide posts 156 initially fitting into the guide sleeves 106. As the rig manifold 150 is moved closer to the riser manifold 100, the flow connectors 160, 110 mate with one another; the small guide posts 176, 186 on the male stab plates 170, 180 then engage the receptacles 126, 136 on the mating plates 120, 130; and the various couplings 122, 124/172, 174 and 132/182 finally mate together. Ultimately, the cam-locks 156 on the guide posts 154 are rotated to lock in the sleeves (106).

Figure 9A:
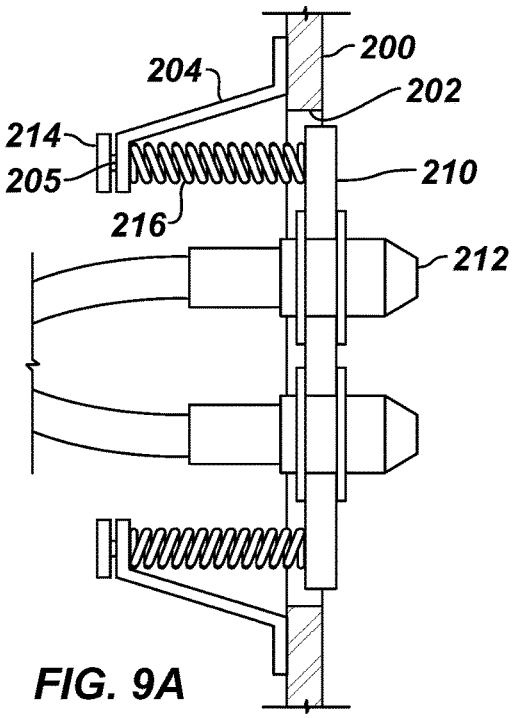
FIGS. 9A-9B schematically illustrate a mating plate of the present disclosure adjustable relative to the face of the manifold.
Figure 9B:
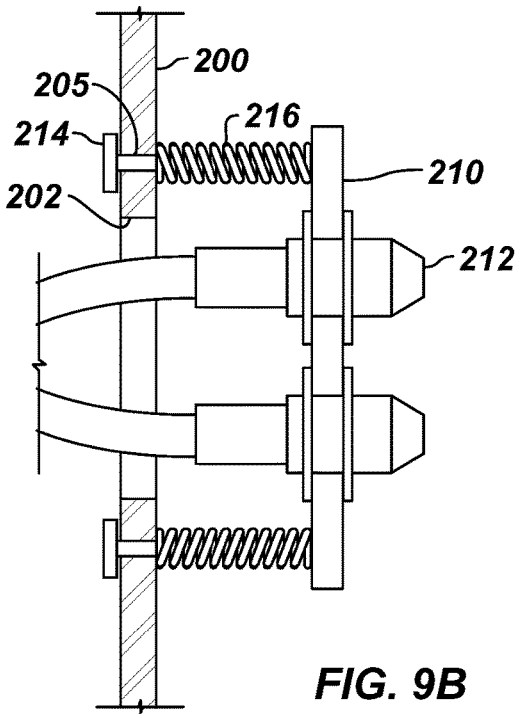

As noted above, the mating plates, such as the stab plates 170, 180 on the rig manifold 150, are "floating," meaning the plates 170, 180 can adjust relative to the face of the rig manifold 150. It is possible for the mating plates on the riser manifold to instead be floating or to also be floating. FIGS. 9A-9B schematically illustrate a mating plate 210 of the present disclosure adjustable relative to a face 200 of a manifold. The mating plate 210 can be any of the mating plates disclosed herein on the manifolds.

As shown in FIG. 9A, the face 200 of the manifold defines an opening 202 into an internal cavity of the manifold. The mating plate 210 is mounted in the opening 202 and supports the control couplings 212 thereon. One or more adjustable fixtures support the mating plate 210 in the opening 202 and allow the plate 210 to adjust relative to the manifold's face 200. For instance, the plane of the plate 210 may adjust relative to the plane of the face 200.

A number of different adjustable fixtures could be used. As shown here, pins 212 extend from the back of the plate 210 and can slide longitudinally in brackets 204 attached in the opening 202 of the manifold. Biasing springs 216 on the sliding pins 214 push the plate 210 outward from the face 200 and allow the pins 214 to adjust longitudinally in the brackets 204. Additional freedom of movement can be provided by allowing the pins 214 to move laterally in slots 205 in the brackets 204 so that the plate 210 can adjust laterally in the opening 202.

As shown an alternative arrangement in FIG. 9B, pins 212 extend from the back of the plate 210 and can slide longitudinally in the face 200 of the manifold. Biasing springs 216 on the sliding pins 214 push the plate 210 outward from the face 200 and allow the pins 214 to adjust longitudinally in the face 200. Additional freedom of movement can be provided by allowing the pins 214 to move laterally in slots 205 in the face 200 so that the plate 210 can adjust laterally.

Figure 9C:
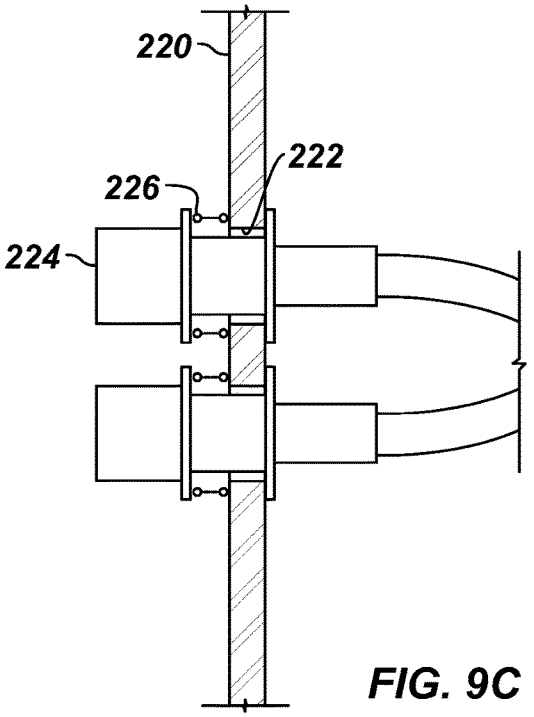
FIG. 9C schematically illustrates a mating plate of the present disclosure having a coupling adjustable relative to the face of a manifold.

As noted herein, each coupling on a mating plate, such as the couplings 172, 174 on the rig manifold's mating plate 170 can be adjustable/movable relative to the face 154 of the manifold 150. To that end, FIG. 9C schematically illustrates a mating plate 220 of the present disclosure having a female coupling 224 adjustable relative to the face of a manifold. The plate 220 can be part of the manifold's face or may be affixed thereto. The mating plate 220 defines openings 222 for control couplings 224, such as hydraulic, electrical, and optical communication. A biasing element 226 such as a spring disposed between the coupling 224 and the plate 220 can allow for individual adjustment or movement of the female coupling 224 to facilitate its mating with a corresponding male coupling on the mating plate of the other manifold.

Figure 10:
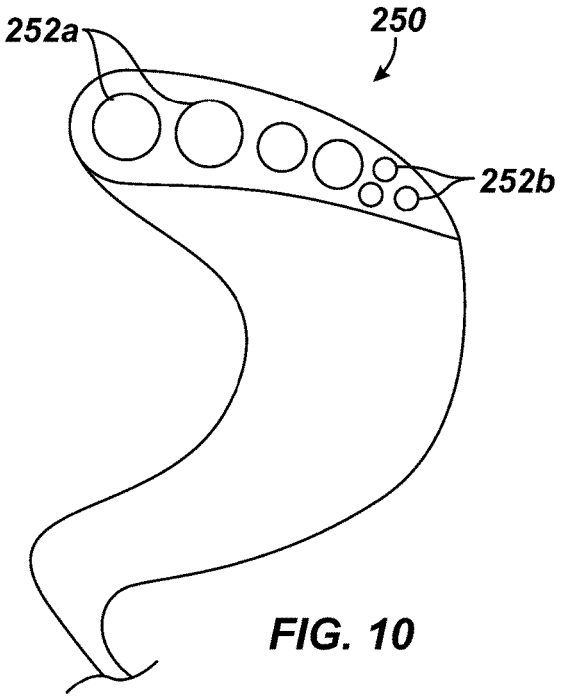
FIG. 10 illustrates a schematic view of a cable for the rig lines of the present disclosure.

FIG. 10 illustrates a schematic view of a cable 250 for the rig lines 252*a-b* of the present disclosure. The rig lines 252*a-b* (e.g., hoses, umbilicals, etc.) leading from the rig (12) to the riser (20) are preferably combined into a single hydrodynamically-shaped bundle for the cable 250. The bundled cable 250 resists vortex-induced vibration (VIV) of the auxiliary hoses and umbilicals and provides for reduced wear and easy handling. A polyurethane profile clamp can be used for bundling the hoses in the cable 250.

Although discussed in conjunction with a rig manifold coupling to a riser manifold using a manipulator arm, the teaching of the present disclosure can be used in other implementations. For example, the teachings can be used for automated subsea stabbing operations of subsea multi-stab connection plates performed with or without an ROV.

Although discussed in conjunction with flow line, hydraulic umbilicals, electric cables, and the like, the teaching of the present disclosure can be used for coupling any number of high-flow and low-flow, high-pressure and low-pressure fluid/hydraulic connections, electrical connections, fiber optic connections, and the like, which can be combined in a single automated subsea stabbing operation with or without the use of an ROV. For example, applications can include: recoverable BOP pods; riser top connections for MPD and combined MPD/termination joint connections on MODUs; and production control systems, such as intelligent well systems, artificial lift, and others.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for connecting rig lines of a managed pressure drilling (MPD) system on a floating rig to a riser, the rig lines including a rig flow line for conducting flow of the MPD system and including a rig control line for conducting control of the MPD system, the riser having an internal passage, the apparatus comprising:

a riser manifold disposed on the riser and having a first face, the riser manifold comprising: a first mechanical connector disposed on the first face, a first flow coupling for conducting the flow of the MPD system, and a first mating plate disposed on the first face, the first mating plate having a first control coupling disposed on the first face for conducting the control of the MPD system; and a rig manifold configured to removably position adjacent the riser manifold and having a second face, the rig manifold comprising: a second mechanical connector disposed on the second face, a second flow coupling disposed on the second face and disposed in fluid communication with the rig flow line for conducting the flow of the MPD system, and a second mating plate disposed on the second face, the second mating plate having a second control coupling disposed in control communication with the rig control line for conducting the control of the MPD system, the first and second mechanical connectors configured to mechanically connect together, the second flow coupling configured to mate in a flow connection with the first flow coupling for conducting the flow of the MPD system, at least one of the first and second mating plates being adjustable relative to the respective first and second face, the second control coupling configured to mate adjustably in a control connection with the first control coupling for conducting the control of the MPD system.

2. The apparatus of claim 1, the rig lines including at least one additional rig flow line in communication with the MPD system, wherein the riser manifold comprises at least one additional first flow coupling for conducting the flow of the MPD system; and wherein the rig manifold comprises at least one additional second flow coupling disposed in flow communication with the at least one additional rig flow line for conducting the MPD flow, the at least one additional second flow coupling configured to mate in at least one additional flow connection with the at least one additional first flow coupling for conducting the flow of the MPD system.

3. The apparatus of claim 1, the rig lines including at least one additional rig control line in communication with the MPD system, wherein the riser manifold comprises at least one additional first control coupling for conducting the control of the MPD system; and wherein the rig manifold comprises at least one additional second control coupling disposed in control communication with the at least one additional rig control line for conducting the control of the MPD system, the at least one additional second control coupling configured to mate in at least one additional control connection with the at least one additional first control coupling for conducting the control of the MPD system.

4. The apparatus of claim 3, wherein the at least one additional first control coupling is disposed on the first face of the riser manifold; wherein the at least one additional second control coupling is disposed on the second face of the rig manifold; and wherein at least one of the at least one additional first and second control couplings is adjustable relative to the respective first and second face, the at least one additional second control coupling configured to mate adjustably in the at least one additional control connection with the at least one additional first control coupling.

5. The apparatus of claim 1, wherein the first mechanical connector comprises a pair of guide sleeves defined in the first face of the riser manifold; and wherein the second mechanical connector comprises a pair of guide posts extending from the second face of the rig manifold, the guide posts configured to insert into the guide sleeves to mechanically connect the rig manifold to the riser manifold.

6. The apparatus of claim 1, wherein the first flow coupling comprises a female receptacle defined in the first face of the riser manifold; and wherein the second flow coupling comprises a male nipple extending from the second face of the rig manifold, the male nipple configured to insert into the female receptacle to make the at least one flow connection.

7. The apparatus of claim 1, wherein the first control coupling comprises at least one of a female electrical coupling, a female hydraulic coupling, and a female fiber optic coupling; and wherein the second control coupling comprises at least one of a male electrical coupling, a male hydraulic coupling, and a male fiber optic coupling, the male control coupling configured to insert into the female control coupling to make the control connection.

8. The apparatus of claim 1, further comprising an arm extending from the floating rig for manipulating the rig manifold, the arm configured to: move the rig manifold relative to the riser manifold, mate the rig manifold to the riser manifold, and disconnect from the rig manifold.

9. The apparatus of claim 8, wherein the arm is further configured to: connect to the rig manifold mated with the riser manifold, and disconnect the rig manifold from the riser manifold.

10. The apparatus of claim 8, wherein the rig manifold defines a plurality of carry slots therein; and wherein the arm comprises a plurality of carry posts removably inserted in the slots of the rig manifold.

11. The apparatus of claim 8, wherein the second mechanical connector comprises a rotatable lock; and wherein the arm comprises a rotatable key removably engaging the rotatable lock.

12. The apparatus of claim 1, wherein the second face defines a cavity therein; and wherein the second mating plate is disposed in the cavity and is adjustable relative to the second face.

13. The apparatus of claim 1, wherein the second mating plate is adjustably longitudinally, laterally, or both relative to the second face.

14. The apparatus of claim 1, wherein the first control coupling is further adjustable relative to the first mating plate on the first face of the riser manifold; and/or wherein the second control coupling is further adjustable relative to the second mating plate on the second face of the rig manifold.

15. The apparatus of claim 1, wherein the flow connection for the first and second flow couplings comprises at least one of: a first MPD connection to a buffer manifold of the MPD system, a second MPD connection to a choke manifold of the MPD system, a boost connection, a glycol injection connection, a hot connection, a spare connection, and a pumped riser connection.

16. The apparatus of claim 1, further comprising a flow control device disposed on the riser and being configured to at least partially control communication of the internal passage of the riser, the flow control device being disposed in at least one of: (i) fluid communication with the second flow coupling and (ii) control communication with the second control coupling.

17. The apparatus of claim 16, wherein the flow control device comprises a valve disposed in fluid communication with the second flow coupling and disposed in control communication with the second control coupling, the valve being controllable to control flow between the second flow coupling and the internal passage of the riser.

18. The apparatus of claim 16, wherein the flow control device comprises a seal being configured to at least partially control flow in the internal passage of the riser.

19. The apparatus of claim 18, wherein the seal comprises an actuator disposed in control communication with the second control coupling.

20. The apparatus of claim 16, the riser having riser lines including a riser flow line for conducting the flow and including a riser control line for conducting the control, wherein the first flow coupling is disposed in fluid communication with the flow control device via the riser flow line, and wherein the first control coupling is disposed in control communication with the flow control device via the riser control line.

21. The apparatus of claim 16, wherein the flow control device comprises a rotating control device, an annular isolation device, or a controllable flow spool valve.

22. An apparatus for connecting rig lines of a managed pressure drilling (MPD) system on a rig to a riser, the rig lines including at least one MPD flow line and at least one MPD control line, the riser having an internal passage, the apparatus comprising:

one or more managed pressure drilling (MPD) devices disposed on the riser and being configured to at least partially control communication of the internal passage of the riser; and a riser manifold disposed on the riser and having a first face, the riser manifold comprising: at least one first mechanical connector disposed on the first face, at least one first flow coupling disposed on the first face for communicating with the fluid controlled by at least one of the one or more MPD devices, and a first mating plate disposed on the first face, the first mating plate having at least one first control coupling disposed in control communication with the at least one of the one or more MPD devices; and a rig manifold configured to removably position adjacent the riser manifold and having a second face, the rig manifold comprising: at least one second mechanical connector disposed on the second face, at least one second flow coupling disposed on the second face and disposed in fluid communication with the at least one MPD flow line, and a second mating plate disposed on the second face, the second mating plate having at least one second control coupling disposed in control communication with the at least one MPD control line, the at least one first and second mechanical connectors configured to mechanically connect together, the at least one second flow coupling configured to mate with the at least one first flow coupling and configured to communicate therewith, at least one of the first and second mating plates being adjustable relative to the respective first and second face, the at least one second control coupling configured to mate adjustably with the at least one first control coupling and configured to communicate therewith.

23. The apparatus of claim 22, wherein the one or more MPD devices comprise one or more of a rotating control device, an annular isolation device, and a controllable flow spool valve.

24. A method of running a riser from a floating rig to a subsea wellhead, the floating rig having a managed pressure drilling (MPD) system connected to rig lines, the rig lines including at least one MPD flow line for conducting flow of the MPD system and including at least one MPD control line for conducting control of the MPD system, the riser having an internal passage, the method comprising not necessarily in sequence:

positioning one or more MPD devices on the riser, the one or more MPD devices being configured to at least partially control communication of the internal passage of the riser;

positioning a riser manifold on the riser, connecting at least one first flow coupling disposed on a first face on the riser manifold in flow communication with at least one of the one or more MPD devices, and connecting at least one first control coupling disposed on a first mating plate on the first face on the riser manifold in control communication with at least one of the one or more MPD devices;

connecting at least one second flow coupling disposed on a second face on a rig manifold to the at least one MPD flow line, and connecting at least one second control coupling disposed on a second mating plate on the second face on the rig manifold to the at least one MPD control line, at least one of the first and second mating plates being adjustable relative to the respective first and second face; and mating the at least one first and second flow couplings in at least one flow connection and adjustably mating the at least one first and second control couplings on the first and second mating plates in at least one control connection by manipulating the rig manifold on an arm toward the riser manifold and remotely mating at least one first mechanical connector disposed on the first face on the riser manifold and at least one second mechanical connector disposed on the second face on the rig manifold together.

* * * * *